US008983335B2

(12) United States Patent
Yamashita et al.

(10) Patent No.: US 8,983,335 B2
(45) Date of Patent: Mar. 17, 2015

(54) PROCESS CARTRIDGE, DEVELOPING DEVICE AND IMAGE FORMING APPARATUS

(71) Applicant: Canon Kabushiki Kaisha, Tokyo (JP)

(72) Inventors: Masatoshi Yamashita, Tokyo (JP); Yuichi Fukui, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 13/804,556

(22) Filed: Mar. 14, 2013

(65) Prior Publication Data

US 2013/0251402 A1 Sep. 26, 2013

(30) Foreign Application Priority Data

Mar. 21, 2012 (JP) ..... 2012-064009

(51) Int. Cl.
*G03G 21/18* (2006.01)

(52) U.S. Cl.
CPC ..... *G03G 21/18* (2013.01); *G03G 21/1825* (2013.01); *G03G 21/1867* (2013.01)
USPC ..... 399/111; 399/90; 399/107; 399/119

(58) Field of Classification Search
USPC ..... 399/25, 107, 111, 113, 119, 88, 90; 439/357, 372, 376
See application file for complete search history.

(56) References Cited

U.S. PATENT DOCUMENTS

| | | | | |
|---|---|---|---|---|
| 6,934,485 | B2 | 8/2005 | Miyabe et al. | |
| 8,396,391 | B2 | 3/2013 | Yamashita | |
| 2007/0092286 | A1 * | 4/2007 | Suzuki et al. | 399/90 |
| 2008/0159775 | A1 * | 7/2008 | Koishi et al. | 399/90 |
| 2008/0159781 | A1 * | 7/2008 | Noguchi et al. | 399/110 |
| 2010/0189460 | A1 * | 7/2010 | Lee | 399/90 |
| 2010/0239306 | A1 * | 9/2010 | Souda | 399/107 |
| 2011/0206412 | A1 * | 8/2011 | Tanabe et al. | 399/111 |
| 2011/0280620 | A1 * | 11/2011 | Chadani et al. | 399/111 |
| 2013/0022368 | A1 | 1/2013 | Takarada et al. | |
| 2013/0114972 | A1 * | 5/2013 | Takarada et al. | 399/110 |
| 2013/0164029 | A1 * | 6/2013 | Fukui et al. | 399/111 |
| 2013/0177334 | A1 * | 7/2013 | Nonaka et al. | 399/111 |
| 2013/0308971 | A1 * | 11/2013 | Kashiide et al. | 399/106 |
| 2014/0050503 | A1 * | 2/2014 | Chadani et al. | 399/111 |

* cited by examiner

*Primary Examiner* — David Gray
*Assistant Examiner* — Francis Gray
(74) *Attorney, Agent, or Firm* — Fitzpatrick, Cella, Harper & Scinto

(57) ABSTRACT

A process cartridge for an image forming apparatus includes a first frame supporting the photosensitive drum; a developing roller; a process member actable on the developing roller; a second frame supporting the developing roller and the process member, the second frame being movable between a contact position where the developing roller contacts the drum and a spacing position where the developing roller is spaced from the drum; a developing device contact; and a process member contact, wherein when the second frame is moved between the contact position and the spacing position, a movement path of the developing device contact overlaps a movement path of process member contact, as seen along the axial direction.

22 Claims, 13 Drawing Sheets

(a)

(b)

(a)

(b)

(a)

(b)

(a)

(b)

(a)

(b)

(a)

(b)

PROCESS CARTRIDGE, DEVELOPING DEVICE AND IMAGE FORMING APPARATUS

FIELD OF THE INVENTION AND RELATED ART

The present invention relates to a process cartridge, a developing device, and an image forming apparatus.

The steps through which an image is formed (recorded) on recording medium by an electrophotographic image forming apparatus such as a printer which uses an electrophotographic image formation process are as follows. First, the surface of a photosensitive member is uniformly charged. Then, the various points of the uniformly charged portion of the surface of the photosensitive member are selectively exposed to form a latent image on the uniformly charge portion of the photosensitive member. Then, this latent image is developed with the use of developer, into a visible image formed of the developer. Then, the visible image formed of the developer is transferred onto recording medium. Then, the image formed of the developer is fixed to the recording medium by the application of heat and pressure to the image formed of the developer and the recording medium.

An electrophotographic image forming apparatus such as the one described above needs to be replenished with developer, and also, its various processing means need to be maintained. One of the means employed for making it easier to replenish an electrophotographic image forming apparatus with developer and/or maintaining the processing means of the apparatus is the so-called process cartridge system, which integrally places all or some of an electrophotographic member, a charging means, a developing means, a cleaning means, etc., in a cartridge, so that they can be removably installed in the main assembly of an electrophotographic image forming apparatus.

The process cartridge system enables even an ordinary user to maintain an electrophotographic image forming apparatus, since a process cartridge which contains all or some of the abovementioned components and/or developer can be easily replaced by a user. Thus, the process cartridge system can greatly improve an electrophotographic image forming apparatus in operability. Therefore, the process cartridge system is widely used in the field of an electrophotographic image forming apparatus.

However, in order for a process cartridge system to be able to contribute to the formation of an image, it has to be supplied with electrical power. In addition, recent process cartridges are given such functions as continuously detecting the amount of toner therein, automatically winding their toner seal away from themselves, and the like. Thus, they need to be supplied with the electric power for these functions, in addition to the electrical power for the conventional purposes. U.S. Pat. No. 6,934,485 discloses one of the methods for reliably supplying the developing device in a process cartridge with electric power. According to this patent, the electrical contacts of a process cartridge are located at one of the lengthwise ends of the process cartridge.

However, conventional art such as the above-described one is problematic for the following reason. That is, an electrophotographic image forming apparatus which uses a developing means of the contact type, which is one of the widely known art, is provided with a mechanism for moving the developing device to separate the developing device from the electrophotographic photosensitive member, or place the developing device back in contact with the electrophotographic photosensitive member, in order to minimize the problem that the surface layer of the electrophotographic photosensitive layer is abraded by the developing device, and the like.

Thus, a process cartridge has to be provided with not only the space for the electrical contacts themselves, but also, the space for allowing the electrical contacts to move with the developing device when the developing device is moved to separate its development roller from the photosensitive member in the process cartridge, or place the development roller back in contact with the photosensitive drum. With the recent trend of further reducing in size a process cartridge and an image forming apparatus, it has become even more difficult to secure the space for the electrical contacts of a developing device and the space for their movement.

SUMMARY OF THE INVENTION

The present invention is a further development of the structure of a process cartridge in accordance with the prior art, in terms of the positioning of the electrical contacts of the cartridge.

The present invention was made in consideration the above-described concerns. Thus, the primary object of the present invention is to provide a combination of an electrophotographic image forming apparatus, a developing device, and a process cartridge, which is significantly smaller than a conventional one, and yet is superior in terms of the reliability of power supply to a developing device to any conventional combination of an electrophotographic image forming apparatus, a developing device therefor, and a process cartridge therefor.

According to an aspect of the present invention, there is provided a process cartridge detachably mountable to a main assembly of the image forming apparatus, comprising an electrophotographic photosensitive member; a first frame supporting said electrophotographic photosensitive member; a developing roller for developing, with a developer, an electrostatic latent image formed on said electrophotographic photosensitive member; a process member actable on said developing roller; a second frame supporting said developing roller and said process member, said second frame being movable relative to said first frame between a contact position where said developing roller contacts said electrophotographic photosensitive member and a spacing position where said developing roller is spaced from said electrophotographic photosensitive member; a developing device contact which is provided at the one end portion side of said second frame with respect to an axial direction of the developing roller and which is electrically connected with said developing roller, wherein said developing device contact is contacted to a first main assembly contact provided in said main assembly of the apparatus when said cartridge is mounted to said main assembly of the apparatus; and a process member contact which is provided at one end portion side of said second frame with respect to the axial direction of the developing roller and which is electrically connected with said process member, wherein said process member contact is contacted to a second main assembly contact provided in said main assembly of the apparatus when said cartridge is mounted to said main assembly of the apparatus, wherein when said second frame is moved between the contact position and the spacing position, a movement path along which said developing device contact moves overlaps a movement path along which said process member contact moves, as said developing device contact and said process member contact are seen along the axial direction.

According to another aspect of the present invention, there is provided a process cartridge detachably mountable to a main assembly of the image forming apparatus, comprising an electrophotographic photosensitive member; a first frame supporting said electrophotographic photosensitive member; a developing roller for developing, with a developer, an electrostatic latent image formed on said electrophotographic photosensitive member; a developing blade for regulating a thickness of a layer of the developer carried on said developing roller; a developer feeding member for supplying the developer to said developing roller; a second frame supporting said developing roller, said developing blade and said developer feeding member, said second frame being movable relative to said first frame between a contact position where said developing roller contacts said electrophotographic photosensitive member and a spacing position where said developing roller is spaced from said electrophotographic photosensitive member; a developing device contact which is provided at the one end portion side of said second frame with respect to an axial direction of the developing roller and which is electrically connected with said developing roller, wherein said developing device contact is contacted to a first main assembly contact provided in said main assembly of the apparatus when said cartridge is mounted to said main assembly of the apparatus; a first process member contact which is provided at one end portion side of said second frame with respect to the axial direction of the developing roller and which is electrically connected with said developing blade, wherein said first process member contact is contacted to a second main assembly contact provided in said main assembly of the apparatus when said cartridge is mounted to said main assembly of the apparatus; and a second process member contact which is provided at one end portion side of said second frame with respect to the axial direction of the developing roller and which is electrically connected with said developer feeding member, wherein said second process member contact is contacted to a third main assembly contact provided in said main assembly of the apparatus when said cartridge is mounted to said main assembly of the apparatus, wherein when said second frame is moved between the contact position and the spacing position, a movement path along which said developing device contact moves overlaps a movement path along which said first process member contact moves, and a movement path along which said developing device contact moves overlaps a movement path along which said second process member contact moves, as said developing device contact, said first process member contact and said second process member contact are seen along the axial direction.

According to a further aspect of the present invention, there is provided a developing device detachably mountable to a main assembly of the image forming apparatus, said developing device comprising a developing roller for developing, with a developer, an electrostatic latent image formed on an electrophotographic photosensitive member; a process member actable on said developing roller; a frame supporting said developing roller and said process member, said frame being movable relative to the main assembly of the apparatus between a contact position where said developing roller contacts said electrophotographic photosensitive member and a spacing position where said developing roller is spaced from said electrophotographic photosensitive member; a developing device contact which is provided at the one end portion side of said frame with respect to an axial direction of the developing roller and which is electrically connected with said developing roller, wherein said developing device contact is contacted to a first main assembly contact provided in said main assembly of the apparatus when said developing device is mounted to said main assembly of the apparatus; and a process member contact which is provided at one end portion side of said frame with respect to the axial direction of the developing roller and which is electrically connected with said process member, wherein said process member contact is contacted to a second main assembly contact provided in said main assembly of the apparatus when said developing device is mounted to said main assembly of the apparatus, wherein when said frame is moved between the contact position and the spacing position, a movement path along which said developing device contact moves overlaps a movement path along which said process member contact moves, as said developing device contact and said process member contact are seen along the axial direction.

According to a further aspect of the present invention, there is provided a developing device detachably mountable to an image forming apparatus, said developing device comprising: a developing roller for developing, with a developer, an electrostatic latent image formed on an electrophotographic photosensitive member; a developing blade for regulating a thickness of a layer of the developer carried on said developing roller; a developer feeding member for supplying the developer to said developing roller; a frame supporting said developing roller, said developing blade and said developer feeding member, said frame being movable relative to the main assembly of the apparatus between a contact position where said developing roller contacts said electrophotographic photosensitive member and a spacing position where said developing roller is spaced from said electrophotographic photosensitive member; a developing device contact which is provided at the one end portion side of said frame with respect to an axial direction of the developing roller and which is electrically connected with said developing roller, wherein said developing device contact is contacted to a first main assembly contact provided in said main assembly of the apparatus when said developing device is mounted to said main assembly of the apparatus; a process member contact which is provided at one end portion side of said frame with respect to the axial direction of the developing roller and which is electrically connected with said developing blade, wherein said process member contact is contacted to a second main assembly contact provided in said main assembly of the apparatus when said developing device is mounted to said main assembly of the apparatus; and a second process member contact which is provided at one end portion side of said frame with respect to the axial direction of the developing roller and which is electrically connected with said developer feeding member, wherein said second process member contact is contacted to a third main assembly contact provided in said main assembly of the apparatus when said developing device is mounted to said main assembly of the apparatus, wherein when said frame is moved between the contact position and the spacing position, a movement path along which said developing device contact moves overlaps a movement path along which said first process member contact moves, and a movement path along which said developing device contact moves overlaps a movement path along which said second process member contact moves, as said developing device contact, said first process member contact and said second process member contact are seen along the axial direction.

According to a further aspect of the present invention, there is provided an image forming apparatus for forming an image on a recording material, said apparatus comprising (i) a main assembly; (ii) a first main assembly contact provided in said main assembly; (iii) a second main assembly contact provided in said main assembly; (iv) a process cartridge dismountably mounted in the main assembly of the apparatus of the image forming apparatus, said process cartridge including an electrophotographic photosensitive member, a first frame supporting said electrophotographic photosensitive member, a developing roller for developing, with a developer, an electrostatic latent image formed on said electrophotographic photosensitive member, a process member actable on said developing roller, a second frame supporting said developing roller and said process member, said second frame being movable relative to said first frame between a contact position where said developing roller contacts said electrophotographic photosensitive member and a spacing position where said developing roller is spaced from said electrophotographic photosensitive member, a developing device contact which is provided at the one end portion side of said second frame with respect to an axial direction of the developing roller and which is electrically connected with said developing roller, wherein said developing device contact is contacted to a first main assembly contact when said cartridge is mounted to said main assembly of the apparatus, and a process member contact which is provided at one end portion side of said second frame with respect to the axial direction of the developing roller and which is electrically connected with said process member, wherein said process member contact is contacted to a second main assembly contact when said cartridge is mounted to said main assembly of the apparatus, wherein when said second frame is moved between the contact position and the spacing position, a movement path along which said developing device contact moves overlaps a movement path along which said process member contact moves, as said developing device contact and said process member contact are seen along the axial direction; and (v) feeding means for feeding the recording material.

According to a further aspect of the present invention, there is provided an image forming apparatus for forming an image on a recording material, said apparatus comprising (i) a main assembly; (ii) a first main assembly contact provided in said main assembly; (iii) a second main assembly contact provided in said main assembly; (iv) a third main assembly contact provided in said main assembly; (v) a process cartridge dismountably mounted in the main assembly of the apparatus of the image forming apparatus, said process cartridge including, an electrophotographic photosensitive member, a first frame supporting said electrophotographic photosensitive member; a developing roller for developing, with a developer, an electrostatic latent image formed on said electrophotographic photosensitive member; a developing blade for regulating a thickness of a layer of the developer carried on said developing roller; a developer feeding member for supplying the developer to said developing roller; a second frame supporting said developing roller, said developing blade and said developer feeding member, said second frame being movable relative to said first frame between a contact position where said developing roller contacts said electrophotographic photosensitive member and a spacing position where said developing roller is spaced from said electrophotographic photosensitive member, a developing device contact which is provided at the one end portion side of said second frame with respect to an axial direction of the developing roller and which is electrically connected with said developing roller, wherein said developing device contact is contacted to a first main assembly contact when said cartridge is mounted to said main assembly of the apparatus, a first process member contact which is provided at one end portion side of said second frame with respect to the axial direction of the developing roller and which is electrically connected with said developing blade, wherein said first process member contact is contacted to a second main assembly contact when said cartridge is mounted to said main assembly of the apparatus, and a second process member contact which is provided at one end portion side of said second frame with respect to the axial direction of the developing roller and which is electrically connected with said developer feeding member, wherein said second process member contact is contacted to a third main assembly contact when said cartridge is mounted to said main assembly of the apparatus, wherein when said second frame is moved between the contact position and the spacing position, a movement path along which said developing device contact moves overlaps a movement path along which said first process member contact moves, and a movement path along which said developing device contact moves overlaps a movement path along which said second process member contact moves, as said developing device contact, said first process member contact and said second process member contact are seen along the axial direction; and (vi) feeding means for feeding the recording material.

According to a further aspect of the present invention, there is provided an image forming apparatus for forming an image on a recording material, said apparatus comprising (i) a main assembly; (ii) a first main assembly contact provided in said main assembly; (iii) a second main assembly contact provided in said main assembly; (iv) a developing device dismountably mounted to said main assembly of the apparatus, said developing device including, a developing roller for developing, with a developer, an electrostatic latent image formed on an electrophotographic photosensitive member, a process member actable on said developing roller, a frame supporting said developing roller and said process member, said frame being movable relative to the main assembly of the apparatus between a contact position where said developing roller contacts said electrophotographic photosensitive member and a spacing position where said developing roller is spaced from said electrophotographic photosensitive member, a developing device contact which is provided at the one end portion side of said frame with respect to an axial direction of the developing roller and which is electrically connected with said developing roller, wherein said developing device contact is contacted to a first main assembly contact provided in said main assembly of the apparatus when said developing device is mounted to said main assembly of the apparatus, and a process member contact which is provided at one end portion side of said frame with respect to the axial direction of the developing roller and which is electrically connected with said process member, wherein said process member contact is contacted to a second main assembly contact provided in said main assembly of the apparatus when said developing device is mounted to said main assembly of the apparatus, wherein when said frame is moved between the contact position and the spacing position, a movement path along which said developing device contact moves overlaps a movement path along which said process member contact moves, as said developing device contact and said process member contact are seen along the axial direction; and (v) feeding means for feeding the recording material.

According to a further aspect of the present invention, there is provided an image forming apparatus for forming an image on a recording material, said apparatus comprising (i) a main assembly; (ii) a first main assembly contact provided in said main assembly; (iii) a second main assembly contact provided in said main assembly; (iv) a third main assembly contact provided in said main assembly; (v) a developing device dismountably mounted to said main assembly, said developing device including, a developing roller for developing, with a developer, an electrostatic latent image formed on an electrophotographic photosensitive member; a developing blade for regulating a thickness of a layer of the developer carried on said developing roller; a developer feeding member for supplying the developer to said developing roller; a frame supporting said developing roller, said developing blade and said developer feeding member, said frame being movable relative to the main assembly of the apparatus between a contact position where said developing roller contacts said electrophotographic photosensitive member and a spacing position where said developing roller is spaced from said electrophotographic photosensitive member; a developing device contact which is provided at the one end portion side of said frame with respect to an axial direction of the developing roller and which is electrically connected with said developing roller, wherein said developing device contact is contacted to a first main assembly contact provided in said main assembly of the apparatus when said developing device is mounted to said main assembly of the apparatus; a process member contact which is provided at one end portion side of said frame with respect to the axial direction of the developing roller and which is electrically connected with said developing blade, wherein said process member contact is contacted to a second main assembly contact provided in said main assembly of the apparatus when said developing device is mounted to said main assembly of the apparatus, and a second process member contact which is provided at one end portion side of said frame with respect to the axial direction of the developing roller and which is electrically connected with said developer feeding member, wherein said second process member contact is contacted to a third main assembly contact provided in said main assembly of the apparatus when said developing device is mounted to said main assembly of the apparatus; wherein when said frame is moved between the contact position and the spacing position, a movement path along which said developing device contact moves overlaps a movement path along which said first process member contact moves, and a movement path along which said developing device contact moves overlaps a movement path along which said second process member contact moves, as said developing device contact, said first process member contact and said second process member contact are seen along the axial direction; and (vi) feeding means for feeding the recording material.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Figure 1:
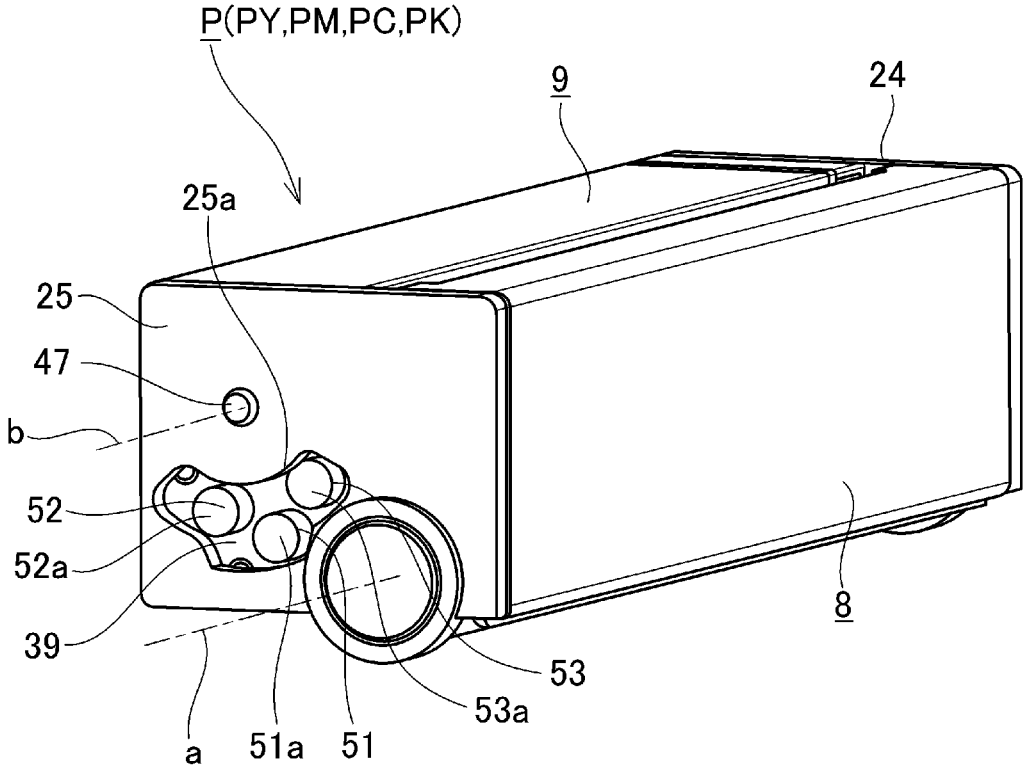
FIG. 1 is a perspective view of the developing device in the first embodiment of the present invention, and shows the general structure of the device.

Hereinafter, embodiments of the present invention are described in detail with reference to appended drawings. However, the following embodiments of the present invention are not intended to limit the present invention in terms of the measurement, material, shape of each of the structural components of a process cartridge to which the present invention is applied, and the positional relationship among the structural components. That is, the present invention is to be modified as necessary according to a process cartridge to which it is applied, and/or various conditions under which the cartridge is used.

The present invention relates to an electrophotographic image forming apparatus such as a copying machine or a printer, which employs an electrophotographic image forming method. It relates also a developing device and a process cartridge, which are used by the electrophotographic image forming apparatus. Here, an "electrophotographic image forming apparatus" means an apparatus which forms an image on recording medium with the use of an electrophotographic image forming method. Examples of an "electrophotographic image forming apparatus" include an electrophotographic copying machine, an electrophotographic printer (laser beam printer, LED printer, etc.), a facsimile machine, a word processor, and the like. A "process cartridge" means a cartridge which integrally holds an electrophotographic photosensitive member (as image bearing member) and at least one among charging means, developing means, and cleaning means (as means for processing image bearing member), and which is removably installable in the main assembly of an "electrophotographic image forming apparatus". A "developing device" means a device which is an integration of developing means used for developing an electrostatic latent image on an electrophotographic photosensitive member. It is a part of a "process cartridge", or in a form of a "development cartridge" which is independent from a "process cartridge", and removably installable into the main assembly of an "electrophotographic image forming apparatus", independently from a "process cartridge".

Embodiment 1

Next, the first embodiment of the present invention is described.

The electrophotographic image forming apparatus in the first embodiment is an electrophotographic full-color printer, which has a cartridge tray in which four process cartridges are removably installable. However, this embodiment is not intended to limit the present invention in terms of the cartridge tray and the number of process cartridges removably installable in the cartridge tray. For example, in the case of a monochromatic image forming apparatus to which the present invention is applicable, the number of the process cartridges employed by the apparatus is only one.

The image forming apparatus in each of the following embodiments of the present invention is a printer. However, the following embodiments are not intended to limit the present invention in terms of the type of an image forming apparatus to which the present invention is applicable. That is, the present invention is also applicable to an image forming apparatus other than a printer. For example, it is applicable to a copying machine, a facsimile machine, a multifunction image forming apparatus capable of performing two of more functions of the aforementioned apparatus, machines, etc., besides a printer.

<<General Structure of Image Forming Apparatus>>

Figure 2:
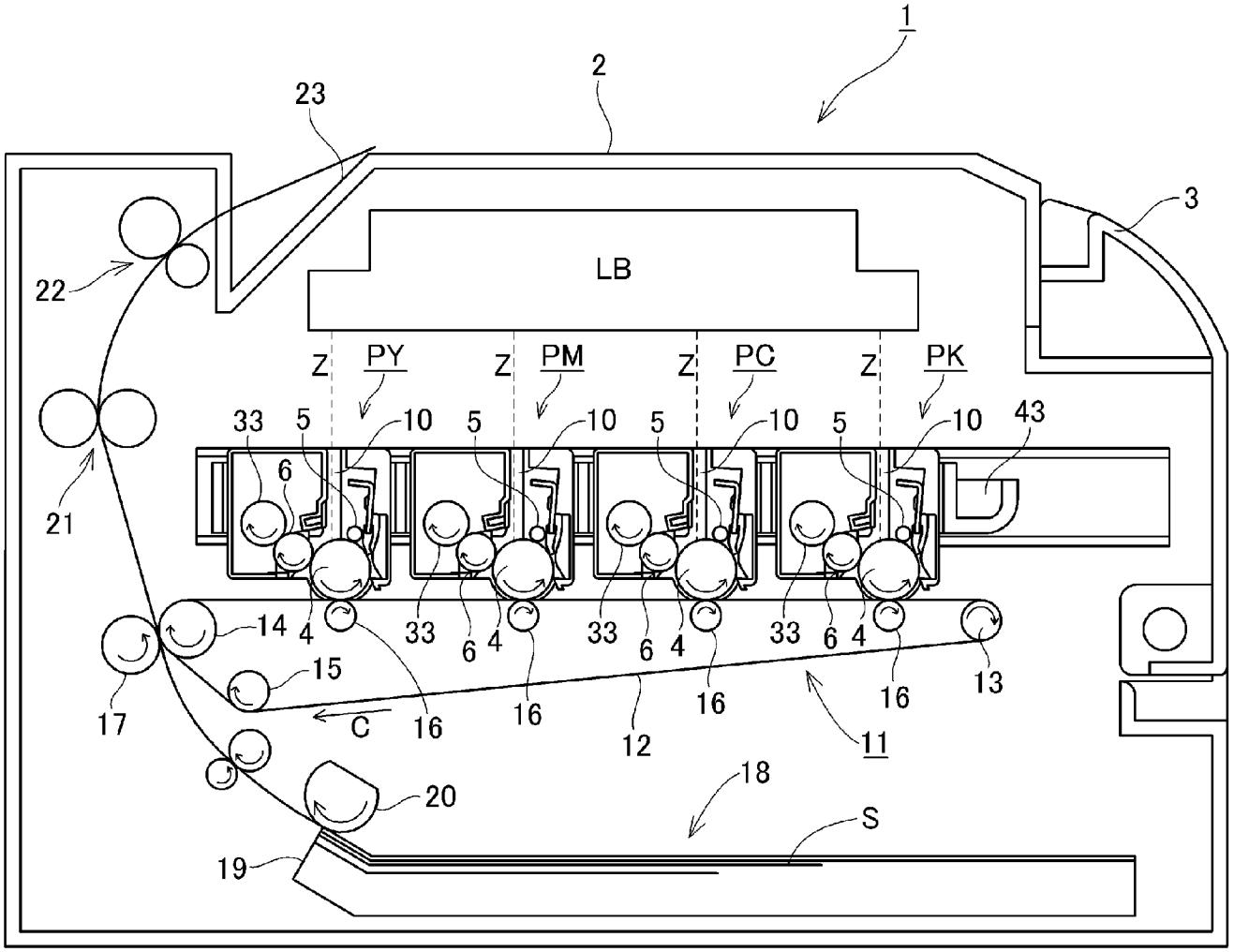
FIG. 2 is a schematic sectional view of the image forming apparatus in the first embodiment, and shows the general structure of the apparatus.

FIG. 2 is a schematic sectional view of the image forming apparatus in the first embodiment of the present invention. It shows the general structure of the apparatus.

Referring to FIG. 2, an image forming apparatus 1 is a full-color laser beam printer based on four primary colors. It can form a full-color image on a sheet S of recording medium with the use of an electrophotographic process. It employs process cartridges P (which hereafter will be referred to simply as cartridge), which are removably installable in its main assembly 2.

Hereafter, the side (surface) of the image forming apparatus 1, which has the main door 3 is referred to as front side (front surface) of the image forming apparatus 1, and the opposite side (surface) from the front side (surface) is referred to as rear side (surface). The side of the image forming apparatus 1, which is on the right-hand side of the image forming apparatus 1 as seen from the front side is referred to as "drive side", and the left side of the image forming apparatus 1 as seen from the front side is referred to as "non-drive side".

The apparatus main assembly 2 holds four cartridges P, more specifically, the first, second, third, and fourth cartridges PY, PM, PC and PK, respectively, which are aligned in tandem, in the direction parallel to the surface on which the apparatus main assembly 2 is positioned.

The four cartridges P (PY, PM, PC and PK) are practically the same in structure and operation, although they are different in the color of the developer they use. Hereafter, therefore, they are going to be described together as cartridge P, that is, without their suffixes (Y, M, C and K) which indicate the color of the developers they use, unless they need to be differentiated.

To each cartridge P, rotational driving force is transmitted from the mechanical driving force output source (unshown) of the apparatus main assembly 2. Further, to each cartridge P, bias voltages (charge bias, development bias, etc.) are supplied from the bias voltage source (unshown) of the apparatus main assembly 2.

Figure 3:
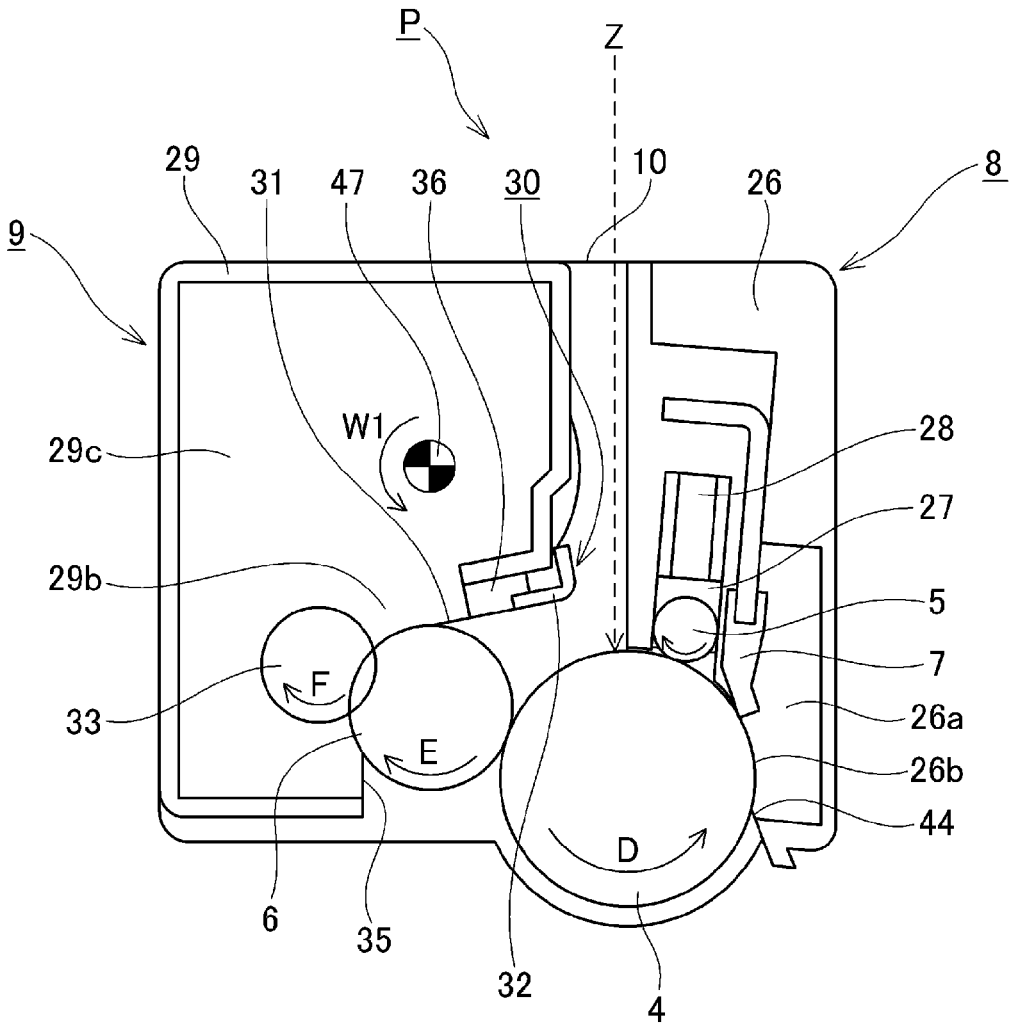
FIG. 3 is a schematic sectional view of the process cartridge in the first embodiment, and shows the general structure of the cartridge.

FIG. 3 is a schematic sectional view of the cartridge P in this embodiment. It shows the general structure of the cartridge P.

Referring to FIG. 3, the cartridge P is made up of a cleaning unit 8 and a developing device 9. The cleaning unit 8 has an electrophotographic photosensitive drum 4 (which will be referred to simply as photosensitive drum hereafter), a charging means, and a cleaning means. The charging means and cleaning means are means for processing the photosensitive drum 4. The developing device 9 has a developing means for developing an electrostatic latent image on the photosensitive drum 4. The cleaning unit 8 and developing device 9 are mechanically connected to each other. The charging means is in the form of a roller (charge roller), and the cleaning means is in the form of a blade (cleaning blade). The developing means is in the form of a developer bearing member (which hereafter will be referred to simply as development roller). The structure of the cartridge P is concretely described later.

The four cartridges P contain four toners, different in color, one for one, in their developing device frame 29. As the electrostatic latent image on the peripheral surface of the photosensitive drum 4 is developed by the developing device 9, a visible image is formed of toner, on the peripheral surface of the photosensitive drum 4 (four visible images formed of toner (which hereafter will be referred to as toner images), different in color, are formed).

The apparatus main assembly 2 is provided with a laser scanner unit LB (as exposing means), which is above the cartridge tray. The laser scanner unit LB is for outputting a beam Z of laser light while modulating the beam Z with the information of the image to be formed. The beam Z of laser light outputted from the laser scanner unit LB passes through the exposure window 10 of the cartridge P, and scans (exposes) the peripheral surface of the photosensitive drum 4.

The apparatus main assembly 2 is also provided with an intermediary transfer belt unit 11 (as transferring member), which is below the cartridge tray. The intermediary transfer belt unit 11 has a belt driving roller 13, a turn roller 14, and a tension roller 15. It has also an endless and flexible transfer belt 12 which is suspended, and kept stretched, by these rollers 13, 14 and 15.

The apparatus main assembly 2 is structured so that the downwardly facing portion of the peripheral surface of the photosensitive drum 4 in each cartridge P remains in contact with the upwardly facing outward surface of the endless transfer belt 12. The area of contact between the peripheral surface of photosensitive drum 4 and transfer belt 12 is the primary transfer station (primary transfer nip). The apparatus main assembly 2 is also provided with a primary transfer roller 16, which is on the opposite of the transfer belt 12 from the photosensitive drum 4 and is in contact with the inward surface of the endless transfer belt 12, sandwiching thereby the transfer belt 12 between itself and photosensitive drum 4.

Further, the apparatus main assembly 2 is provided with a secondary transfer roller 17, which is on the opposite side of the transfer belt 12 from the turn roller 14 and is in contact with the outward surface of the transfer belt 12, sandwiching thereby the transfer belt 12 between itself and turn roller 14.

The area of contact between the transfer belt 12 ad secondary transfer roller 17 is the secondary transfer station (secondary transfer nip).

There is a sheet conveyance unit 8 under the intermediary transfer belt unit 11. This conveyance unit 18 has a sheet feeder tray 19 in which sheets S of recording medium are stored in layers, and a sheet feeder roller 20.

Further, there are a pair of fixation rollers 21 and a pair of discharge rollers 22 in the top left portion of the apparatus main assembly 2 as shown in FIG. 2. Further, a part of the top surface of the apparatus main assembly 2 makes up a delivery tray 23.

After the transfer of a toner image onto a sheet S of recording medium, the sheet S and the toner image thereon are subjected to heat and pressure while it is conveyed by the pair of fixation rollers 21, remaining pinched by the pair of fixation roller 21. Thus, the toner image becomes fixed to the sheet S. Lastly, the sheet S is discharged into the delivery tray 23.

<<Image Forming Operation>>

The operation performed by the image forming apparatus 1 to form a full-color image is as follows.

The photosensitive drum 4 in each cartridge P is rotationally driven at a preset speed (direction indicated by arrow mark D in FIG. 3); counterclockwise direction in FIG. 2). The transfer belt 12 is circularly driven in such a direction (indicated by arrow mark C in FIG. 2) that it moves in the same direction as the peripheral surface of the photosensitive drum 4 in the area of contact between itself and peripheral surface of the photosensitive drum 4, and also, at the same speed as the peripheral velocity of the photosensitive drum 4.

The laser scanner unit LB also is driven. In synchronism with the driving of the laser scanner unit LB, the charge roller 5 in each cartridge P uniformly charges the peripheral surface of the photosensitive drum 4 to a preset polarity and a preset potential level. The laser scanner unit LB scans (exposes) the peripheral surface of the photosensitive drum 4 with the beam Z of laser light which it projects while modulating the beam Z with image formation signals, which correspond to each of the primary color images, into which the image to be formed has been separated.

Consequently, an electrostatic latent image which reflects the image formation signals is effected on the peripheral surface of each photosensitive drum 4. Then, the electrostatic latent image is developed by the development roller 6, which is being driven at a preset speed (in direction indicated by arrow mark F in FIG. 3; clockwise direction in FIG. 2).

Through the above described electrophotographic image formation process, a yellow toner image (image formed of yellow toner), which corresponds to the yellow component of the full-color image, is effected on the peripheral surface of the photosensitive drum 4 in the first cartridge PY, and then, is transferred (primary transfer) onto the transfer belt 12.

Similarly, an image of magenta color which corresponds to the magenta component of the full-color image is formed on the peripheral surface of the photosensitive drum 4 in the second cartridge PM, and then, is transferred (primary transfer) onto the yellow toner image on the transfer belt 12. Further, an image of cyan color which corresponds to the cyan component of the full-color image is formed on the peripheral surface of the photosensitive drum 4 in the third cartridge PC, and then, is transferred (primary transfer) onto the yellow and magenta toner images on the transfer belt 12. Further, an image of black color which corresponds to the black component of the full-color image is formed on the peripheral surface of the photosensitive drum 4 in the fourth cartridge PK, and then, is transferred (primary transfer) onto the yellow, magenta, and cyan toner images on the transfer belt 12.

Consequently, an unfixed full-color image is effected of the four monochromatic toner images, different in color, on the transfer belt 12.

Meanwhile one of the sheets S of recording medium in the sheet feeder tray 19 is fed into the apparatus main assembly 2 with a preset control timing, while being separated from the rest. Then, the sheet S is introduced into the secondary transfer station with preset control timing, and conveyed through the secondary transfer station.

While the sheet S of recording medium is conveyed through the secondary transfer station, the layered four monochromatic toner images, different in color (which make up full-color toner image), on the transfer belt 12 are transferred together onto the sheet S.

<<Structure of Cartridge>>

Figure 4:
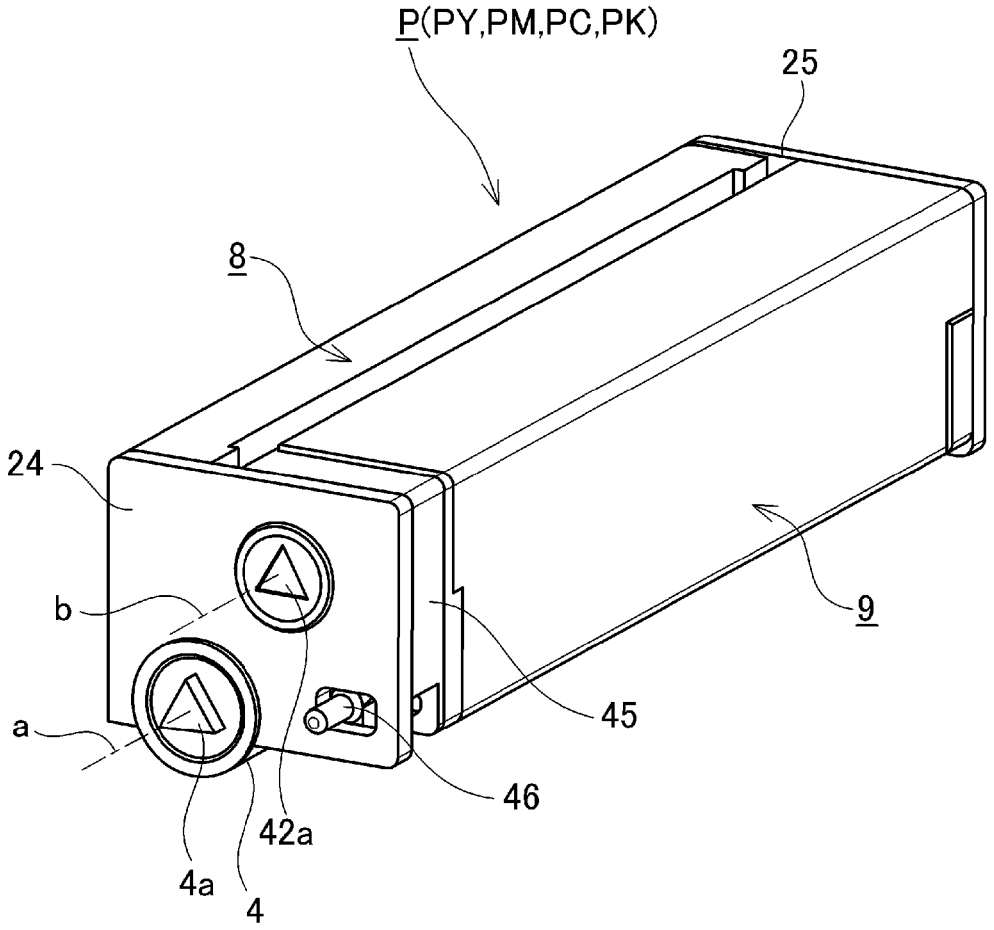
FIG. 4 is a perspective view of the cartridge in the first embodiment.

FIG. 4 is a schematic perspective view of the cartridge P in this embodiment. It shows the external appearance of the cartridge P.

Referring to FIG. 4, the cartridge P is roughly in the form of a rectangular parallelepiped, and its lengthwise direction corresponds with the direction of the axial line a of the photosensitive drum 4. It has the cleaning unit 8, the developing device 9, a drive side cover 24, and a non-drive side cover 25. Hereafter, the direction parallel to the axial line a of the photosensitive drum 4 may be referred to as "lengthwise direction".

Referring to FIG. 3, the cleaning unit 8 is made up of the photosensitive drum 4, charge roller 5, and a cleaning means container 26, which is the first frame having the cleaning blade 7.

The photosensitive drum 4 is rotatably supported by the drive side cover 24 (first frame) and a non-drive side cover 25. It is rotationally driven (in direction indicated by arrow mark D in FIG. 3) by the driving force it receives from the motor (unshown) of the apparatus main assembly 2 through a drum driving coupling 4*a*.

The charge roller 5 is rotatably supported by a pair of charge roller bearings 27 of the cleaning means container 26, by its lengthwise ends. It is in contact with the peripheral surface of the photosensitive drum 4, and is rotated by the rotation of the photosensitive drum 4. As it receives charge bias, it charges the peripheral surface of the photosensitive drum 4. In order to ensure that the peripheral surface of the photosensitive drum 4 is uniformly charged by the charge roller 5, the charge roller 5 is kept pressed toward the photosensitive drum 4 by a pair of compression springs 28.

The cleaning blade 7 is solidly attached to the cleaning means container 26, in such an attitude that its cleaning edge made of elastic rubber, which is placed in contact with the peripheral surface of the photosensitive drum 4, is on the upstream side of its base portion in terms of the rotational direction (indicated by arrow mark D in FIG. 3) of the photosensitive drum 4. During an image forming operation, the cleaning blade 7 scrapes away the transfer residual toner on the peripheral surface of the photosensitive drum 4 to clean the peripheral surface of the photosensitive drum 4. In order to ensure that the transfer residual toner is completely scraped away, the cleaning edge of the cleaning blade 7 is kept pressed upon the peripheral surface of the photosensitive drum 4 with the application of a preset amount of pressure to the cleaning blade 7.

As the transfer residual toner is scraped away from the peripheral surface of the photosensitive drum 4 by the cleaning blade 7, it is stored as waste toner in the waste toner storage 26*a* of the cleaning means container 26. Thus, the cleaning means container 26 is provided with a waste toner recovery sheet 44 for preventing the transfer residual toner leaking out of the cleaning means container 26 through the gap between the photosensitive drum 4 and cleaning blade 7. The waste toner recovery sheet 44 is solidly attached to the cleaning means container 26 in such a manner that it remains in contact with the peripheral surface of the photosensitive drum 4 from one lengthwise end of the photosensitive drum 4 to the other. Further, the cleaning means container 26 is provided with a pair of cleaning blade end seals (unshown) attached to the lengthwise ends of the cleaning blade 7, one for one.

<<Mechanism for Installation and Removal of Cartridges>>

Next, the operation for installing or removing the cartridge P, into or from, the apparatus main assembly 2 is described.

Figure 5:
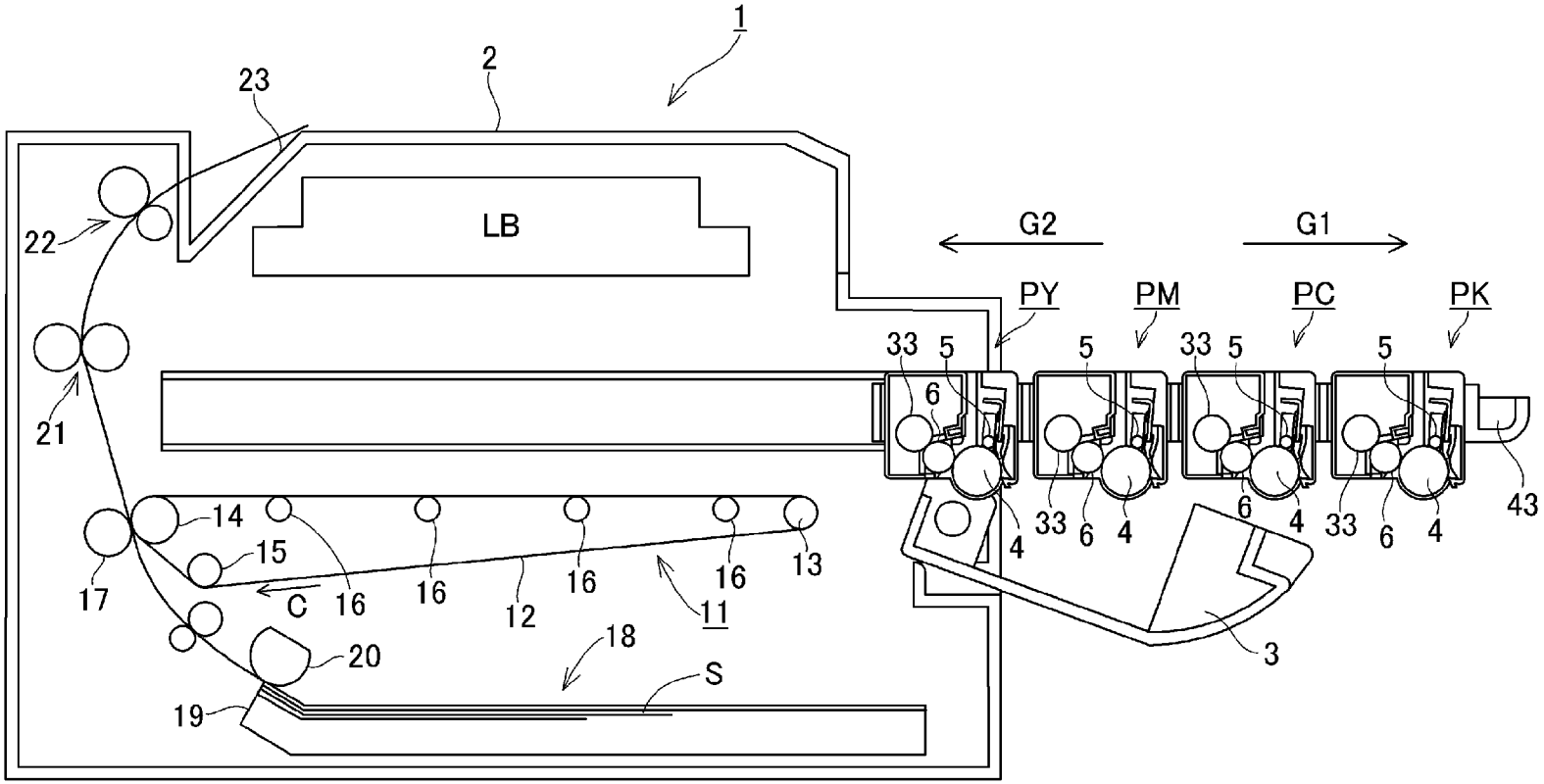
FIG. 5 is a schematic sectional view of the image forming apparatus in the first embodiment, which is ready for the installation or removal of process cartridges.
Figure 6:
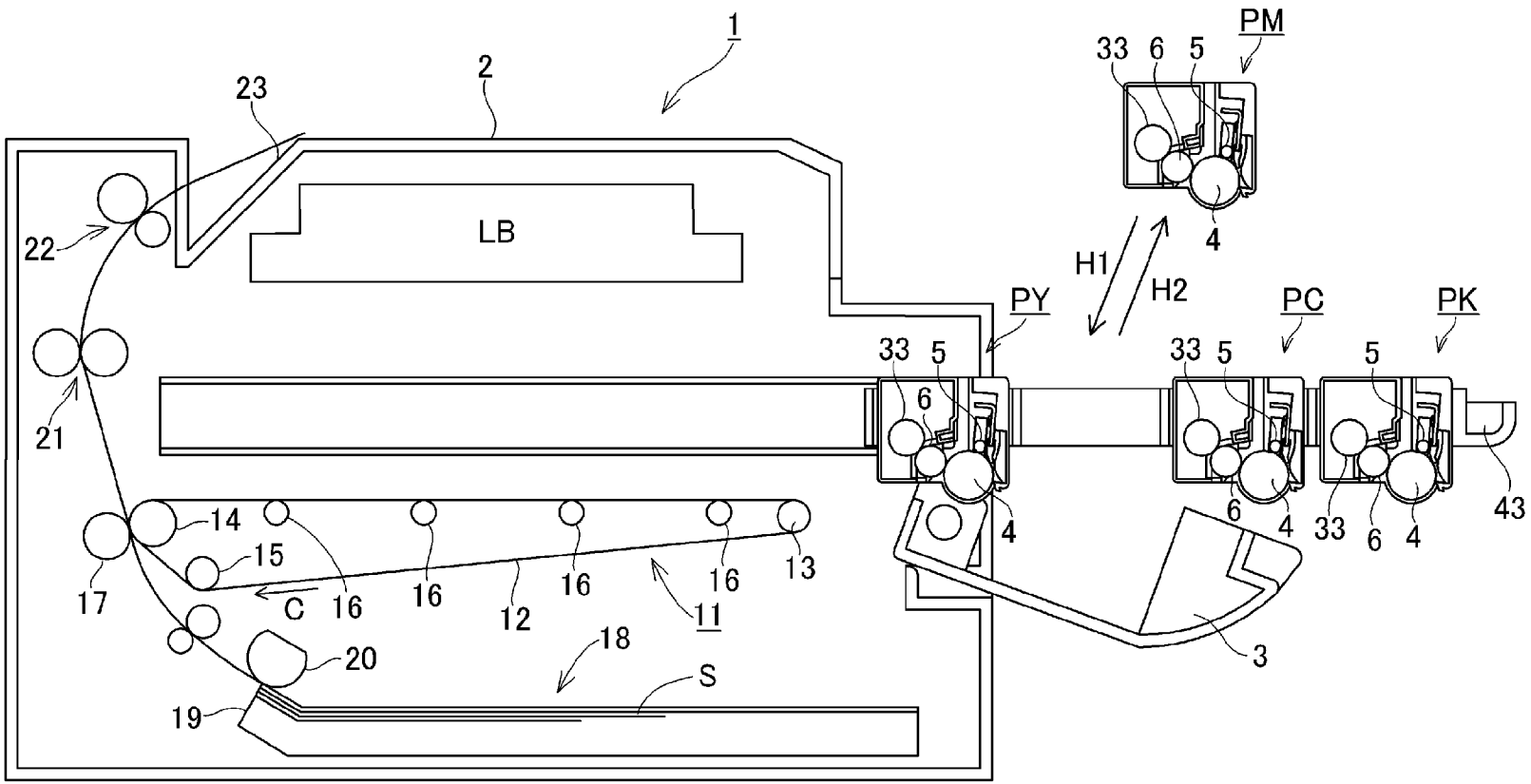
FIG. 6 is a schematic sectional view of the image forming apparatus in the first embodiment, which is ready for the installation or removal of process cartridges, and shows the manner in which the cartridges are installed into, or removed from, the cartridge tray of the apparatus.

FIG. 5 is a schematic sectional view of the image forming apparatus 1 when its cartridge tray 43 is fully outside of the apparatus main assembly 2, being ready for the installation or removal of the cartridge P. FIG. 6 is a schematic sectional view of the image forming apparatus 1 when its cartridge tray 43 is in its outermost position. It is for showing the operation for installing or removing the cartridge P, into or from, the cartridge tray 43.

The image forming apparatus 1 is provided with the cartridge tray 43 into which the four cartridges are removably installable. Referring to FIG. 5, the image forming apparatus 1 is structured so that the cartridge tray 43 can be linearly moved (pushed into, or pulled out of, apparatus main assembly 2) in the practically horizontal direction G1 or G2, relative to the apparatus main assembly 2. The cartridge tray 43 can be held in the its inside position in the apparatus main assembly 2, into which it is pushed into, or the outside position into which it is pulled out of the apparatus main assembly 2.

First, the operation for installing the cartridge P into the apparatus main assembly 2 is described.

First, the front door 3 of the apparatus main assembly 2 is to be opened, and the cartridge tray 43 is to be moved in the direction indicated by an arrow mark G1 in FIG. 5 until the tray 43 moves into its outside position. It is when the cartridge tray 43 is in this outside position that the cartridge P can be installed into the cartridge tray 43 in the direction indicated by an arrow mark H1 in FIG. 6, and can be held in the cartridge tray 43. Then, the cartridge tray 43, which is holding cartridges P, is to be moved in the direction indicated by an arrow mark G2 in FIG. 5 until it moves into its inside position. Then, the front door 3 is to be closed to end the installation of the cartridges P into the apparatus main assembly 2.

Next, the operation for removing the cartridges P out of the apparatus main assembly 2 is described.

First, the cartridge tray 43 is to be moved into its outside position in the same manner as it is for the installation of the cartridge P. It is when the cartridge tray 43, which is holding the cartridge P, is in its outside position that the cartridge P (cartridges P) can be moved out of the cartridge tray 43 in the direction indicated by an arrow mark H2 in FIG. 6 to end the operation for removing the cartridge P from the apparatus main assembly 2.

That is, the cartridge P can be installed into, or removed from, the apparatus main assembly 2 through the above described operations.

<<Structure of Developing Device>>

Figure 7:
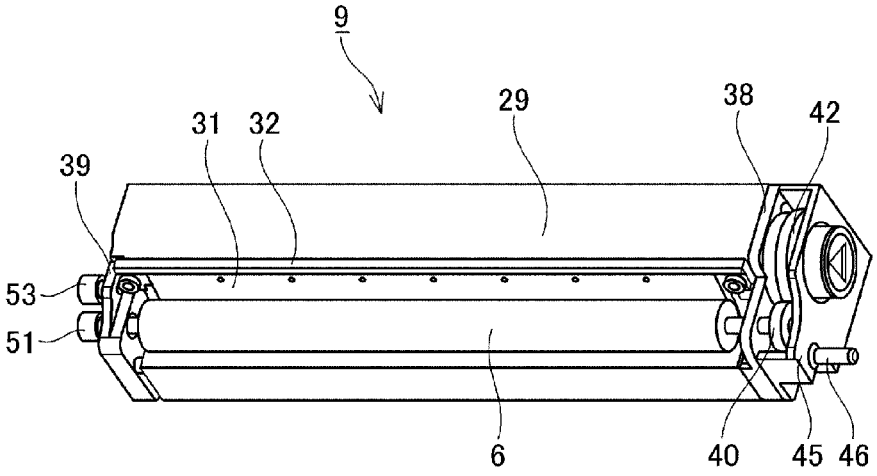
FIG. 7 is a perspective view of the developing device, and shows the general structure of the developing device.
Figure 7:
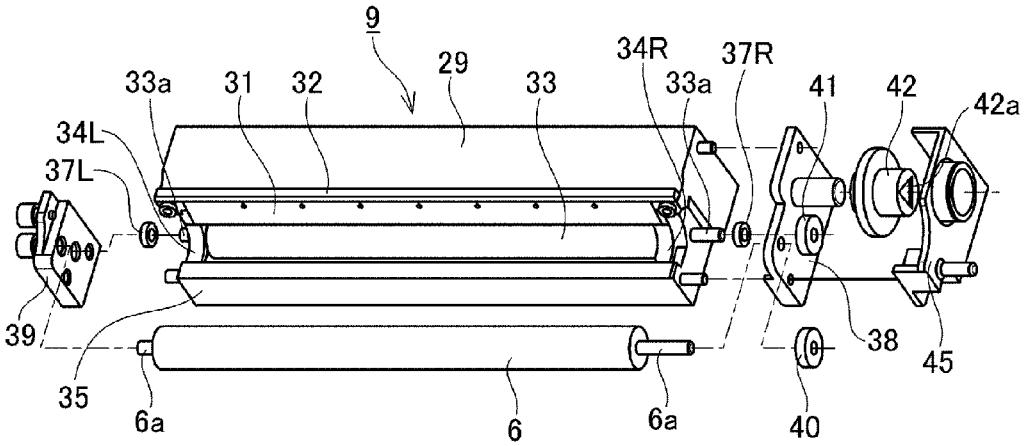

FIG. 7 is a schematic perspective view of the developing device 9 in this embodiment. It shows the general structure of the device 9.

First, referring FIG. 7(*a*), the developing device 9 is in such a form that its lengthwise direction is parallel to the axial line of the development roller 9 which it contains. It is made up of the frame 29 (second frame), a development blade 31, a developer supply roller 33, a pair of end seals 34R and 34L, a flexible sheet 35, a pair of supply roller end seals 37R and 37L, in addition to the development roller 6. The development blade 31 is one of the components which process the development roller 6. The developer supply roller 33 (component for supplying development roller with developer) also is one of the components which process the development roller 6.

The frame 29 has a toner storage chamber 29*c* in which toner is stored, and an opening 29*b* through which toner is discharged from the toner storage chamber 29*c*.

The development roller 6 and developer supply roller 33 are positioned at the opening 29*b* of the frame 29, and are rotatably supported by their lengthwise ends, by the drive side bearing 38 and non-drive side bearing 39. The frame 29, drive side baring 38, and non-drive side bearing 39 make up the frame of the developing device 9.

The developing device 9 is provided with a development roller gear 40 and a supply roller gear 41, which are attached to the drive side lengthwise end of the core member 6*a* of the development roller 6, and the drive side lengthwise end of the core member 33*a* of the developer supply roller 33, respectively. The two gears 40 and 41 are in mesh with an input gear 42 through which the force for driving the developing device 9 is transmitted to the developing device 9. The developing device 9 is also provided with a gear cover 45, which is attached to the drive side bearing 38 and supports the driving force input gear 42. The driving force input gear 42 is provided with a coupling 42*a*, which is engaged with the driving force output coupling (unshown) of the apparatus main assembly 2 so that the driving force from the motor (unshown) of the apparatus main assembly 2 is transmitted to the driving force input gear 42 to rotate the development roller 6 and developer supply roller 33 at a preset speed.

The development blade 31 is made of elastic metallic plate, which is roughly 0.1 mm in thickness. It is attached to the development device frame 29 in such an attitude that its free end (in terms of direction perpendicular to lengthwise direction of blade 31) is in contact with the peripheral surface of the development roller 6, and also, that the free end is on the upstream side of its base portion in terms of the rotational direction of the development roller 6.

Next, referring to FIG. 7(*b*), the lengthwise end seals 34R and 34L are positioned at the lengthwise ends of the developing device frame 29, one for one, to prevent toner from leaking through the gap between the development blade 31 and developing device frame 29, and the gap between the development roller 6 and developing device frame 29.

The flexible sheet 35 is for preventing toner from leaking out of the developing device 9 through the gap between the developing device frame 29 and development roller 6. It is attached to the opposite edge of the opening 29*b* of the developing device frame 29 from where the development blade 31 is positioned, and is in contact with the peripheral surface of the development roller 6 (FIGS. 3 and 7(*b*)). The supply roller shaft seals 37R and 37L are attached to the portions of the core member 33*a* of the developer supply roller 33, which are outside the developing device frame 29. They prevent toner from leaking from the developing device frame 29 through the gap between the edge of the hole of the developing device frame 29, through which the core member 33*a* of the developer supply roller 33 is put, and the peripheral surface of the core member 33*a*.

Referring to FIG. 3, the developing device 9 is provided with a pair of shafts (pivot) 47 (axial line of which coincides with axial line b shown in FIG. 1), with which the developing device 9 is rotatably supported by the main section (more specifically, drive side cover 24 and non-drive side cover 25) of the cartridge P. The direction in which the shafts 47 (axial line of which coincides with axial b in FIG. 1) extend is parallel to the rotational axis a of the photosensitive drum 4, and also, the rotational axis of the development roller 6.

Thus, the developing device 9 is pivotally movable about the shafts 47 (axial line b in FIG. 1). Further, it is always kept pressured by a pair of compression springs (unshown) in such a direction (indicated by arrow mark W1 in FIG. 3) that its development roller 6 is placed in contact with the photosensitive drum 4. Thus, the development roller 6 remains in contact with the photosensitive drum 4. Hereafter, this position of the developing device 9, which keeps the development roller 6 in contact with the photosensitive drum 4, is referred to as "contact position".

During an image forming operation, the developer supply roller 33 and development roller 6 rub against each other by being driven by the driving force from the apparatus main assembly 2. Thus, the toner in the developing device frame 29 is borne on the development roller 6. The development blade 31 regulates in thickness the toner layer formed on the peripheral surface of the development roller 6, and also, frictionally charges the toner between itself and the development roller 6 by being kept pressed upon the toner layer on the peripheral surface of the development roller 6.

As the charged toner on the development roller 6 adheres to the electrostatic latent image on the photosensitive drum 4, in the area of contact between the development roller 6 and photosensitive drum 4, the electrostatic latent image is developed into a visible image, that is, toner image.

The developing device 9 in this embodiment is a part of the cartridge P which is removably installable in the apparatus main assembly 2. However, this embodiment is not intended to limit the present invention in terms of the type of developing device. That is, the present invention is also applicable to a developing device which is structured so that it can be removably installable in the apparatus main assembly 2 independently from the cartridge P.

<<Operation for Separating Development Roll of Developing Device from Development Drum in Cleaning Unit>>

The apparatus main assembly 2 is provided with a means (mechanism) for separating the development roller 6 of the cartridge P from the photosensitive drum 4 of the cartridge P when the cartridge P is in the apparatus main assembly 2.

The image forming apparatus 1 can be reduced in the amount of abrasion of the peripheral surface of the photosensitive drum 4, occurrence of indentation to the peripheral surface of the development roller 6, and deterioration of development roller 6, by keeping the development roller 6 separated from the photosensitive drum 4 while no image is formed by the image forming apparatus 1.

Figure 8:
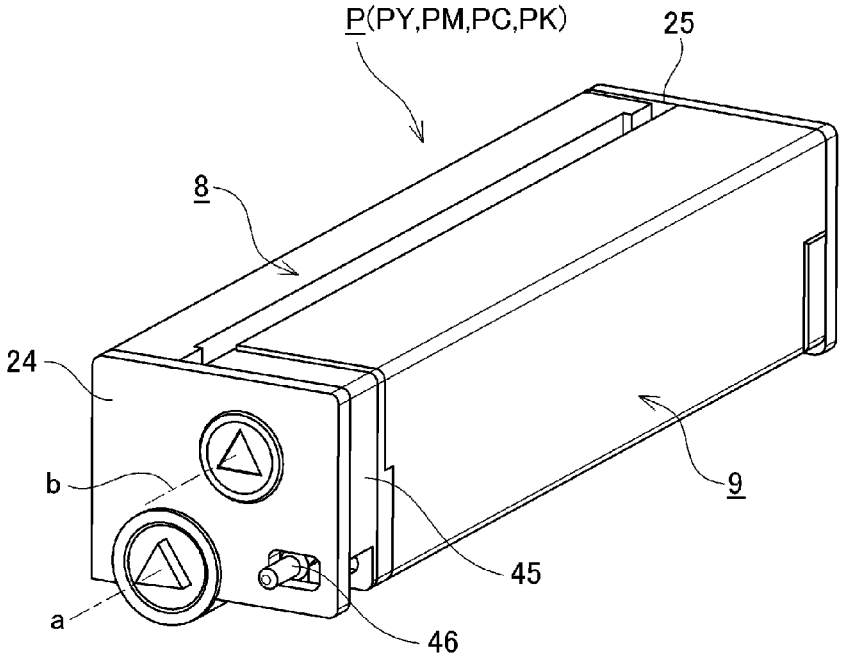
FIG. 8 is a perspective view of the process cartridge in the first embodiment, which is for showing how the developing device is pivotally moved to separate its development roller from the photosensitive drum in the cleaning means of the process cartridge P.
Figure 8:
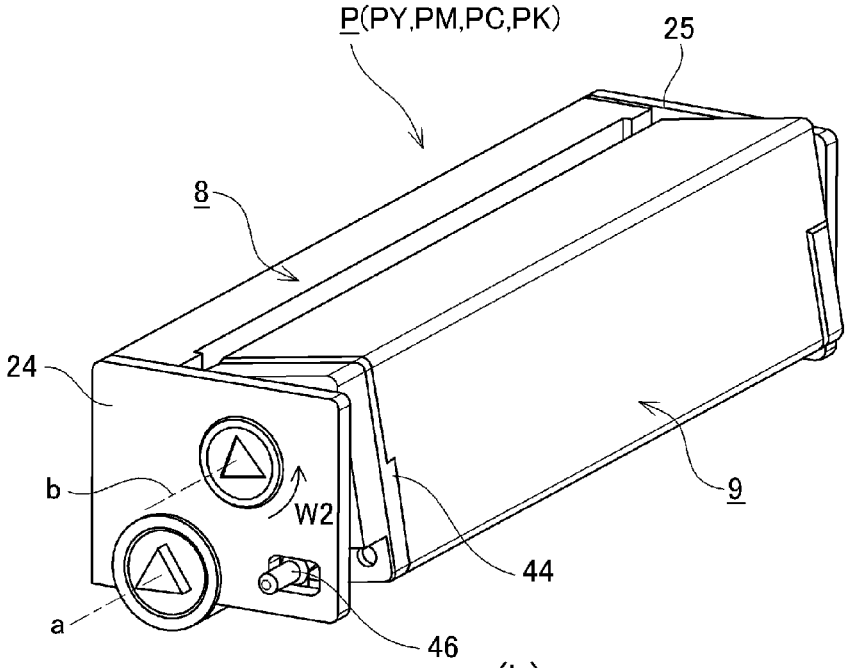

FIG. 8 is a schematic sectional view of the cartridge P, which is for describing the operation for separating the development roller 6 from the photosensitive drum 4.

When no image is formed by the image forming apparatus 1, the developing device 9 is pivotally moved about the shafts 47 (axial line b in FIG. 1) by an unshown separating means so that the developing device 9 is moved relative to the cleaning unit 8 in such a direction (indicated by arrow mark W2 in FIG. 8(*b*)) that the development roller 6 is separated from the photosensitive drum 4, against the resiliency of the aforementioned pair of compression springs (unshown). That is, the compression springs are utilized to change the cartridge P in the position of the developing device 9, between the aforementioned "contact position" in which the development roller 6 remains in contact with the photosensitive drum 4 and the aforementioned "separation position" in which the development roller 6 remains separated from the photosensitive drum 4. Since the developing device 9 is provided with the pair of shaft 47 (pivots: axial line b in FIG. 1), the developing device 9 is allowed to move between the "contact position" and "separation position".

<<Structure of Electrical Contacts of Developing Device>>

Next, referring to FIGS. 9-12, the method for supplying the development roller 6, developer supply roller 33, and development blade unit 30 with electrical power is described. The structural arrangement for applying electrical voltage to the development roller 6 and the structural arrangement for applying electrical voltage to the developer supply roller 33 are the identical. Thus, only the structure arrangement for applying electrical voltage to the development roller 6 is described; the structural arrangement for applying electrical voltage to the developer supply roller 33 is not described.

Figure 9:
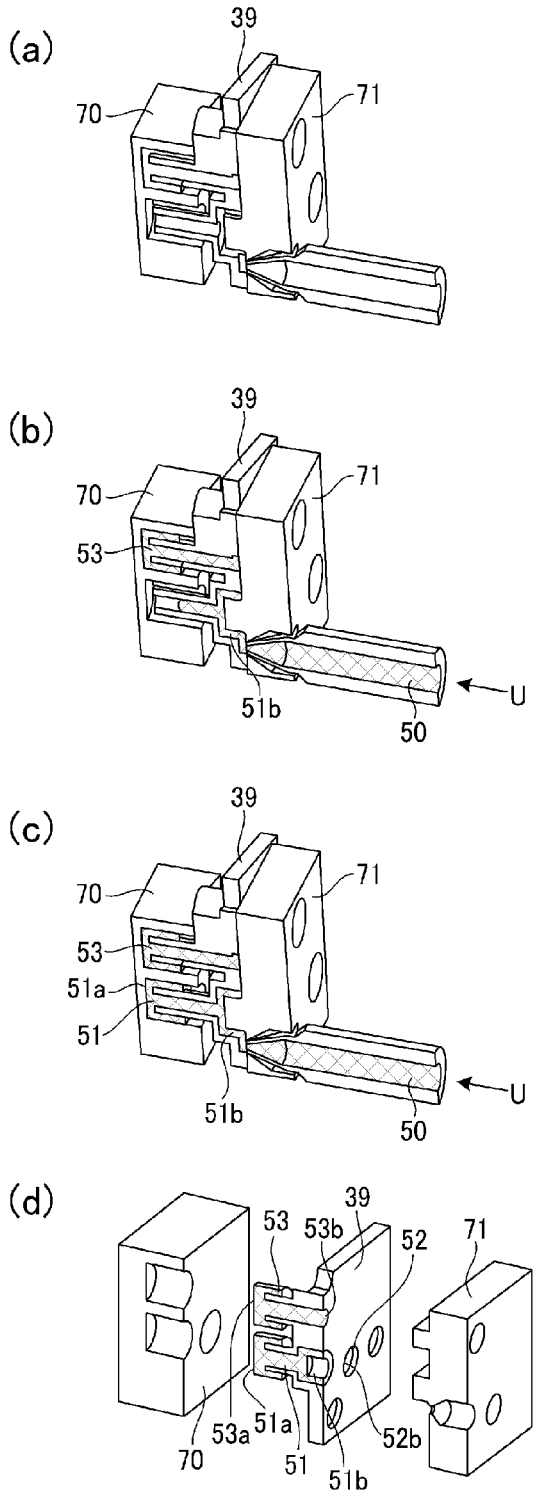
FIG. 9 is a schematic perspective view of a combination of the non-drive side cartridge bearing, that is, the bearing which is at the lengthwise end of the cartridge, from which the cartridge is not driven, and cartridge bearing molds, which is for showing the steps through which the bearing is made.

FIG. 9 is a schematic perspective view of a combination of the non-drive side cartridge bearing 39 (which is integral with electrical contact of development roller 6, electrical contact of developer supply roller 33, and electrical contact of development blade unit 30), and cartridge bearing molds. It shows the steps through which the bearing 39 is made.

Referring to FIG. 9, in this embodiment, the electrical contacts 51, 52, and 53 are formed as integral parts of the non-drive side bearing 39 (integral parts of developing device frame 29) by injecting electrically conductive resin 50 (resinous substance indicated by hatching in FIG. 9) into the space (gap) formed between the non-drive side bearing 39 and molds 70 and 71 which sandwich the non-drive side bearing 39. The non-drive side bearing 39 is to be made of nonconductive substance. It may be formed of resinous substance, for example.

FIG. 9(*a*) shows the state of the non-drive side bearing 39 before the injection of the resin 50 into the gap between the bearing 39 and mold 70 and the gap between the bearing 38 and mold 71. FIG. 9(*b*) shows the state of the non-drive side bearing 39 during the injection of the resin 50 into the gap between the bearing 39 and mold 70 and the gap between the bearing 39 and mold 71 in the direction indicated by an arrow mark U. FIG. 9(*c*) shows the state of the non-drive side bearing 39 immediately after the completion of the injection of the resin 50 into the gap between the bearing 39 and mold 70 and the gap between the bearing 39 and mold 71. FIG. 9(*d*) shows the state of the non-drive side bearing 39 after the separation of the molds 70 and 71 from the non-drive side bearing 39.

The electrical contacts 51, 52 and 53 are formed together of electrically conductive resin 50. Therefore, they are electrically conductive. However, they are physically independent from each other.

Figure 10:
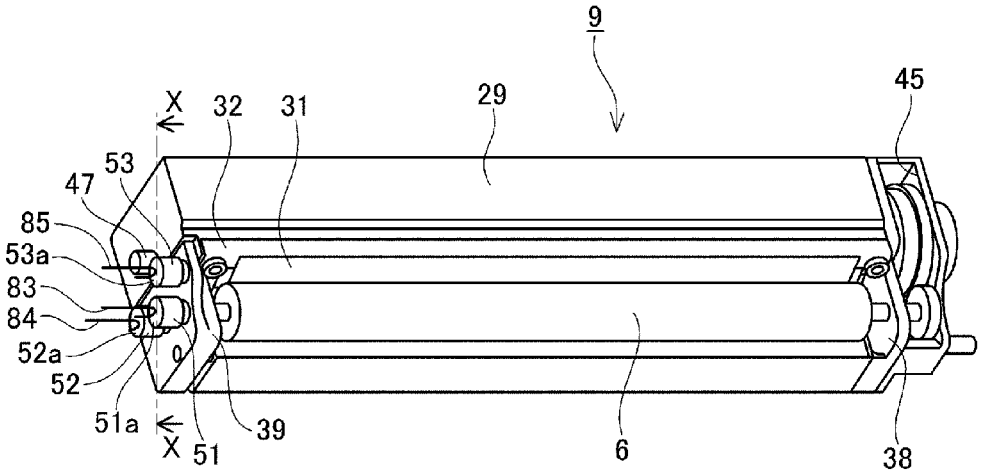
FIG. 10 is a schematic perspective view of the developing device, after the attachment of its non-drive side bearing to the developing device.
Figure 10:
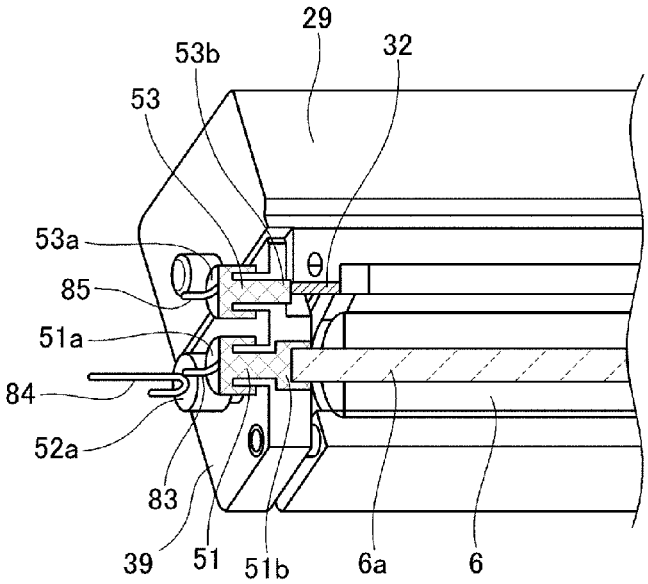

FIG. 10 is a schematic perspective drawing of the non-drive side bearing 39 after the attachment of the bearing 39 to the developing device 9. Referring to FIG. 10(*b*), the electrical contact 51 of the development roller 6 and the electrical contact 53 of the development blade unit 30 are integral parts of the non-drive side bearing 39.

The electrical contact 51 (development contact) of the non-drive side bearing 39, which is for the development roller 6, has the first and second surfaces of contact. Hereafter, the first surface of contact, which is placed in contact with the electrode 83 (first point of contact of apparatus main assembly 2) of the apparatus main assembly 2, will be referred to as surface 51*a* of contact, whereas the second surface of contact will be referred to as a core member supporting portion 51*b*. The surface 51*a* of contact, which contacts the electrode 83 of the apparatus main assembly 2 (which hereafter will be referred to as main assembly electrode 83), remains exposed from the developing device frame 29, and extends outward in parallel to the rotational axis of the development roller 6.

Next, referring to FIG. 10(*a*), as the cartridge P is installed into the apparatus main assembly 2, the surface 51*a* of contact of the non-drive side bearing 39 comes into contact with the main assembly electrode 83.

As for the core member supporting portion 51*b*, it makes up the opposite end of the electrical contact 51 from the surface 51*a* of contact of the electrical contact 51, in terms of the direction of the axial line of the development roller 6, and is shaped so that it can rotatably support the core member 6*a* of the development roller 6.

That is, the cover member supporting portion 51*b* rotatably supports one of the lengthwise end portions of the core member 6*a* of the development roller 6, and is in contact with the end and peripheral surfaces of the lengthwise end portion of the core member 6*a*.

As voltage is applied to the main assembly electrode 83 in response to a command from the controller (unshown) of the apparatus main assembly 2 after the installation of the cartridge P into the apparatus main assembly 2, the voltage is applied to the peripheral surface of the development roller 6 by way of the surface 51*a* of contact (which is in contact with main assembly electrode 83), core member supporting portion 51*b*, and core member 6*a*. That is, the electrical contact 51 of the non-drive side bearing 39 is provided to establish electrical connection between the development roller 6 and main assembly electrode 83.

In this embodiment, electrical connection is established between the main assembly electrode 83 and electrical contact 51 by placing the main assembly electrode 83 directly in contact with the electrical contact 51. However, this embodiment is not intended to limit the present invention in terms of how electrical contact is to be established between the main assembly electrode 83 and electrical contact 51. That is, the electrical contact between the main assembly electrode 83 and electrical contact 51 may be indirect. For example, an electrically conductive component may be placed between the main assembly electrode 83 and electrical contact 51.

As described above, the structure for applying voltage to the developer supply roller 33 is the same as the structure for applying voltage to the development roller 6. That is, the electrical contact (first processing member contact) 52 of the developer supply roller 33 of the non-drive bearing 39 has a surface 52*a* of contact (as the first portion of electrical contact), which comes into contact with a main assembly electrode (main assembly second electrode) 84, and a core member supporting portion 52*b* (as the second portion of electrical contact).

An electrical contact (second processing member contact) 53 of the development blade unit 30 of the non-drive side bearing 39 has the first and second surfaces of contact. Hereafter, the first surface of contact, which is placed in contact with the electrode 85 (first point of contact of apparatus main assembly 2) of the apparatus main assembly 2, will be referred to as surface 53*a* of contact, whereas the second surface of contact will be referred to as a core member supporting portion 53*b*. The surface 53*a* of contact, which contacts the electrode 85 of the apparatus main assembly 2, remains exposed from the developing device frame 29, and extends outward in parallel to the rotational axis of the development roller 6.

As the cartridge P is installed into the apparatus main assembly 2, the surface 53*a* of contact of the non-drive side bearing 39 comes into contact with the main assembly electrode 85 of the apparatus main assembly 2.

As for the core member supporting portion 53*b*, it is in contact with the lengthwise end surface of the development blade supporting metallic plate 32, on the opposite side of the electric contact 53 from the surface 53*a* of contact, in terms of the direction parallel to the rotational axis of the development roller 6.

As voltage is applied to the main assembly electrode 85 in response to a command from the controller of the apparatus main assembly 2 after the installation of the cartridge P into the apparatus main assembly 2, the voltage is applied to the development blade unit 30 by way of the surface 53*a* of contact (which is in contact with main assembly electrode 85), surface 53*b* of contact, and development blade supporting metallic plate 32.

That is, the electrical contact 53 of the non-drive side bearing 39 is provided to establish electrical connection between the development blade unit 30 and main assembly electrode 85.

In this embodiment, electrical connection between the main assembly electrode 85 and electrical contact 53 is established by placing the main assembly electrode 85 directly in contact with the electrical contact 53. However, this embodiment is not intended to limit the present invention in terms of how electrical connection is to be established between the main assembly electrode 85 and electrical contact 53. That is, the electrical connection between the main assembly electrode 85 and electrical contact 53 may be indirect. For example, an electrically conductive component may be placed between the main assembly electrode 85 and electrical contact 53.

Next, the positioning of these electrical contacts is described.

Figure 11:
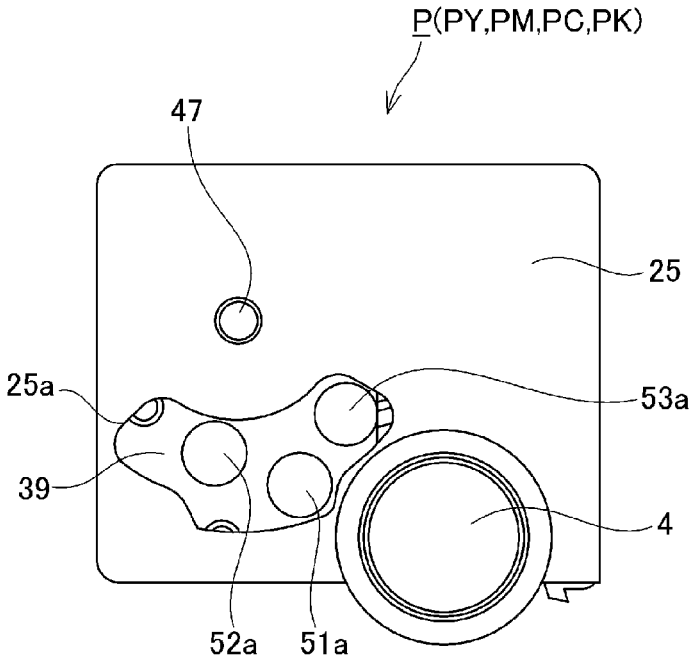
FIG. 11 is a side view of the process cartridge in the first embodiment, as seen from the side from which it is not driven, and shows the position of the electrical contacts when the developing device is in the contact position, that is, the position in which it keeps its development roller in contact with the photosensitive drum in the cleaning means of the process cartridge, and in the separation position, that is, the position in which the developing device keeps its development roller separated from the photosensitive drum.
Figure 11:
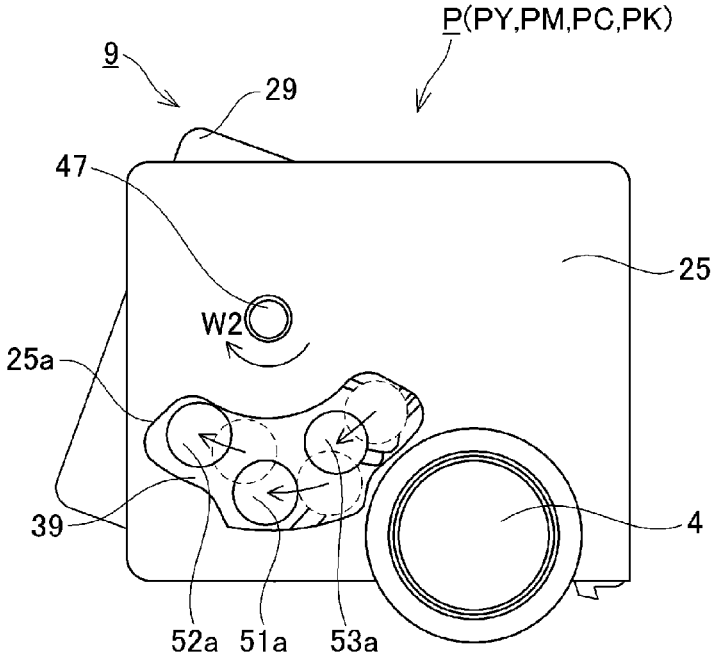
Figure 12:
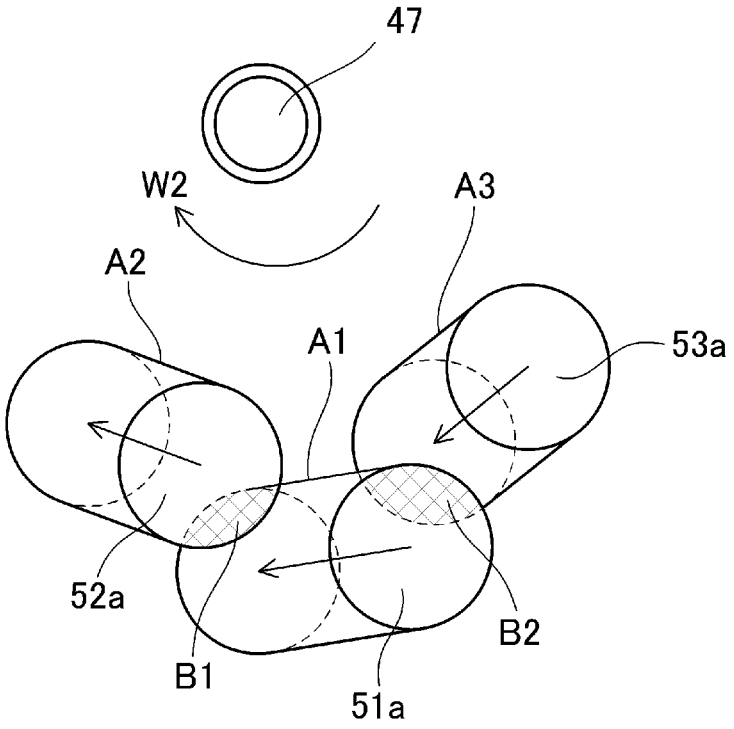
FIG. 12 is an enlarged view of the electrical contact portion of FIG. 11(*b*).

FIG. 11 is a perspective view of the developing device 9 in this embodiment. It shows the general structure of the device 9. FIG. 11(*a*) shows the position of the surfaces 51*a*, 52*a* and 53*a* of contact of the electrical contacts 51, 52 and 53, respectively, when the developing device 9 is in its contact position. FIG. 11(*b*) shows the position of the surfaces 51*a*, 52*a* and 53*a*, of contact of the electrical contacts 51, 52 and 53, respectively, when the developing device 9 is in its separation position. FIG. 12 is an enlarged view of the portion of the FIG. 11(*b*), which shows the surfaces 51*a*, 52*a* and 53*a*.

Referring to FIG. 1, the surface 51*a* of contact of the development roller 6, which come into contact with the main assembly electrode 83, surface 52*a* of contact, which comes into contact with the main assembly electrode 84, and surface 53*a* of contact of the development blade unit 30, which comes into contact with the main assembly electrode 85, are all at the non-drive end of the developing device 9 in terms of the direction parallel to the rotational axis of the development roller 6.

Because the surfaces 51*a*, 52*a* and 53*a* of contact are positioned as described above, it is assured that the developing device 9 is reliably supplied with electrical power.

The electrical connection between the surfaces 51*a*, 52*a* and 53*a* of contact and the main assembly electrodes 83, 84 and 85, respectively, is made through the hole 25*a* of the non-drive end cover 25.

Further, the electrical contacts 51, 52 and 53 are positioned so that as the developing device 9 is pivotally moved about the pair of shafts 47 (axial line b in FIG. 1), the courses of the movement of their surfaces 51*a*, 52*a* and 53*a* of contact overlap. Here, the "courses of movement" means the paths which the surfaces 51*a*, 52*a* and 53*a* of contact follow as the developing device 9 is pivotally moved between its contact position and separation position.

That is, referring to FIG. 12, the electrical contacts 51 and 52 are so positioned relative to each other that the course A1 of movement of the electrical contact 51 partially overlaps with the course A2 of movement of the electrical contact 52 across an area B1. Similarly, the electrical contacts 51 and 53 are so positioned relative to each other that the course A1 of movement of the electrical contact 51 partially overlaps with the course A3 of movement of the electrical contact 53 across the area B2.

More specifically, the developing device 9, which is in its contact position shown in FIG. 11(*a*), is pivotally moved relative to the cleaning unit 8, about the pair of shafts 47 (axial line b in FIG. 1), in such a direction (indicated by arrow mark W2 in FIG. 11(*b*)) that the development roller 6 separates from the photosensitive drum 4.

As the developing device 9 is pivotally moved as described above, the position in which the electrical contact 51 of the development roller 6 is when the developing device is in its contact position, is partially moved into the position in which the electrical contact 53 of the developer supply roller 33 was when the developing device 9 was in its contact position. Further, the position in which the electrical contact 53 of the development blade unit 30 is when the developing device 9 is in its contact position, is partially moved into the position in which the electrical contact 51 of the development roller 6 was when the developing device 9 was in its contact position.

In this embodiment, the cartridge P is structured so that the electrical contacts 51, 52 and 53 are positioned as described above. Therefore, it is superior in special efficiency, inclusive of the courses which the electrical contacts 51, 52 and 53 follow as the developing device 9 is pivotally moved about the pair of shaft 47 in the direction to separate the development roller 6 from the photosensitive drum 4, than any conventional process cartridge (P). In the case of the conventional process cartridge design, the courses A1 and A2 which the electrical contacts 51 and 52 follow, respectively, as the developing device 9 is pivotally moved about the pair of shafts 47, do not partially overlap. Therefore, the space to be reserved for the movement of the electrical contacts 51 and 52 which occurs as the developing device 9 is pivotally moved has to be larger than the space to be reserved for the movement of the electrical contacts 51 and 52 of the cartridge P in this embodiment which is designed so that the courses A1 and A2 of the electrical contacts 51 and 52 partially overlap across the area B1. That is, in this embodiment, the cartridge P is designed so that the position in which the electrical contact 51 of the development roller 6 is when the developing device 9 is in its separation position partially overlaps with the position in which the electrical contact 52 of the developer supply roller 33 is when the developing device 9 is in its contact position. Therefore, the cartridge P is superior in special efficiency in terms of the positioning of the electrical contacts to any of conventional process cartridges. Further, if the space necessary to allow the electrical contacts of the developing device 9 to move is large, the non-drive side bearing 39 of the developing device 9, which is provided with the electrical contacts, has to be large. Thus, using the structural arrangement for the cartridge P, which is in this embodiment, can reduce in size the non-drive side bearing 39, which in turn can reduce in size the developing device itself.

As is evident from the description of the first embodiment of the present invention, not only can the present invention ensure that the developing device 9 is reliably supplied with electrical power, but also, can reduce in size the developing device 9 and cartridge P, which in turn can reduce in size the apparatus main assembly 2.

Further, in this embodiment, the number of the electrical contacts with which the developing 9 is provided were three, which were for the development roller 6, developer supply roller 33, and development blade unit 30, one for one. However, this embodiment is not intended to limit the present invention in terms of the type and number of electrical contacts with which a developing device is to be provided. For example, the present invention is also applicable to a developing device (9) which requires only two electrical contacts, because its development roller (6) and developer supply roller (33) are the same in potential level, or its development roller (6) and development blade unit 30 are the same in potential level. Further, the present invention is also applicable to a process cartridge, the developing device (9) of which does not have the developer supply roller (33). That is, the present invention is applicable to any process cartridge as long as the cartridge is designed so that the two or more electrical contacts of its developing device are located at one of the lengthwise ends of its developing device, in terms of the lengthwise direction of the development roller (6) of the developing device.

Embodiment 2

Next, the second embodiment of the present invention is described.

In the first embodiment, the electrical contacts 51 of the development roller 6 were positioned in the adjacencies of one of the lengthwise ends of the core member of the development roller 6, in alignment with the axial line of the development roller 6, and the electrical contact 52 of the developer supply roller 33 was positioned in the adjacencies of one of the lengthwise ends of the core member of the developer supply roller 33, in alignment with the axial line of the developer supply roller 33. In comparison, the characteristic feature of the second embodiment is that the electrical contacts 51 and 52 of the development roller 6 and developer supply roller 33, respectively, are formed of electrically conductive resin, but, they are not positioned in the adjacencies of the axial line of the development roller 6 and the axial line of the developer supply roller 33, respectively. This embodiment is described about only the structural components of the cartridge P in this embodiment, which are different from the counterparts in the first embodiment; those which are similar to the counterparts in the first embodiment are not going to be described.

Figure 13:
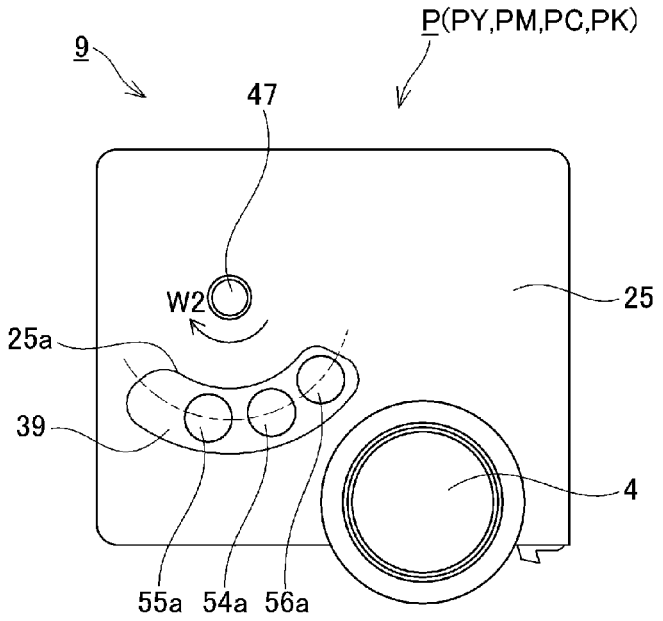
FIG. 13 is a side view of the process cartridge P in the second embodiment, as seen from the non-drive side, and shows the pivotal movement of the developing device and resultant movement of the electrical contacts of the developing device.
Figure 13:
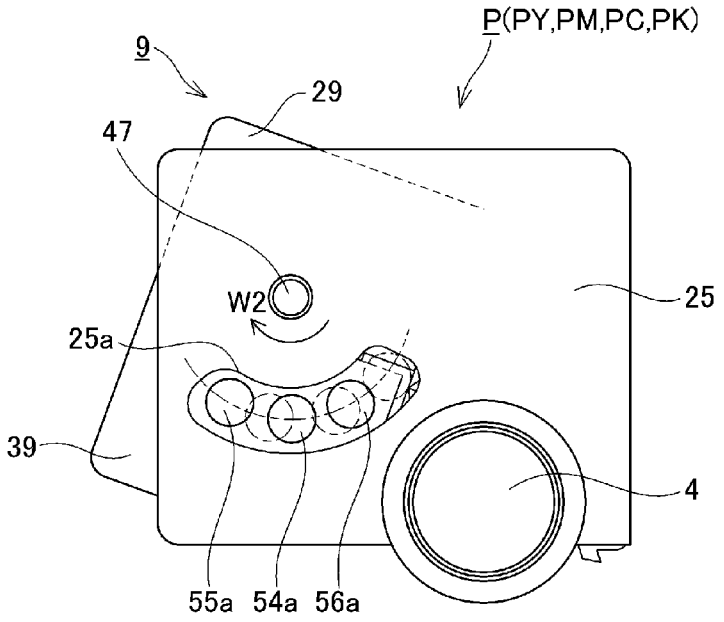

FIG. 13 is a schematic plan view of the non-drive side cover 25 of the cartridge P in this embodiment. More specifically, FIGS. 13(*a*) and 13(*b*) show the lengthwise end of the cartridge P, by which the cartridge P contacts the apparatus main assembly 2, when the developing device 9 is in its contact position and separation position, respectively.

Referring to FIG. 13, the surface 54*a* of contact of the development roller 6, which comes into contact with the main assembly electrode 83, surface 55*a* of contact of the developer supply roller 33, which comes into contact with the main assembly electrode 84, and surface 56*a* of contact of the development blade unit 30, which comes into contact with the main assembly electrode 85 are all at the non-drive end of the developing device 9. Further, the electrical connection between the surfaces 54*a*, 55*a* and 56*a* of contact and the main assembly electrodes 83, 84 and 85, respectively, are all made through the hole 25*a* with which the non-drive side cover 25 is provided.

Further, the surfaces 54*a*, 55*a* and 56*a* of contact are all positioned so that they become the same in the distance from the pair of shaft 47 (axial line b).

The developing device 9 which is in its contact position as shown in FIG. 13(*a*) is moved into its separation position shown in FIG. 13(*b*) as follows. That is, as the developing device 9 is pivotally moved relative to the cleaning unit 8, about the pair of shafts 47 (axial line b) by the developing device separating means, the development roller 6 is moved in the direction (indicated by arrow mark W2 in 13(*b*)) to separate from the photosensitive drum 4.

During the above described pivotal movement of the developing device 9, the electrical contact 54 of the development roller 6 moves from the position in which it was when the developing device 9 is in the contact position, to the position in which the electrical contact 55 of the developer supply roller 33 was when the developing device 9 was in the contact position. Further, the electrical contact 56 of the development blade unit 30 moves from the position in which it is when the developing device 9 is in its contact position, to the position in which the electrical contact 54 of the development roller 6 was when the developing device 9 was in its contact position.

As is evident from the description of the second embodiment given above, not only can the present invention improve a process cartridge in special efficiency in terms of the space for the electrical contacts, by positioning the electrical contacts as described above with the use of electrical conductive resin as the material for the electrical contact, and therefore, can reduce in size the hole 25*a* with the non-drive side cover 25 is provided. Thus, the present invention can reduce in size the developing device 9 and cartridge P, which in turn can reduce in size the apparatus main assembly 2.

That is, not only can the present invention ensure that the developing device 9 is reliably supplied with electrical power, but also, can reduce in size the developing device 9, cartridge P, and image forming apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 064009/2012 filed Mar. 21, 2012 which is hereby incorporated by reference.

What is claimed is:

1. A process cartridge detachably mountable to a main assembly of an image forming apparatus, said process cartridge comprising:

an electrophotographic photosensitive member;

a first frame supporting said electrophotographic photosensitive member;

a developing roller for developing, with a developer, an electrostatic latent image formed on said electrophotographic photosensitive member;

a process member actable on said developing roller;

a second frame supporting said developing roller and said process member, said second frame being movable relative to said first frame between a contact position where said developing roller contacts said electrophotographic photosensitive member and a spacing position where said developing roller is spaced from said electrophotographic photosensitive member;

a developing device contact which is provided at one end portion side of said second frame with respect to an axial direction of said developing roller and which is electrically connected with said developing roller, wherein said developing device contact is contacted to a first main assembly contact provided in the main assembly of the image forming apparatus when said process cartridge is mounted to the main assembly of the image forming apparatus; and a process member contact which is provided at one end portion side of said second frame with respect to the axial direction of said developing roller and which is electrically connected with said process member, wherein said process member contact is contacted to a second main assembly contact provided in the main assembly of the image forming apparatus when said process cartridge is mounted to the main assembly of the image forming apparatus, wherein, when said second frame is moved between the contact position and the spacing position, a movement path along which said developing device contact moves overlaps a movement path along which said process member contact moves, as said developing device contact and said process member contact are seen along the axial direction.

2. A process cartridge according to claim 1, wherein said developing device contact and said process member contact are provided by injection molding electroconductive resin material in said second frame.

3. A process cartridge according to claim 1, wherein said process member includes a developing blade for regulating a thickness of a layer of the developer layer carried on said developing roller.

4. A process cartridge according to claim 1, wherein said process member includes a developer feeding member for supplying the developer to said developing roller.

5. A process cartridge according to claim 1, wherein said developing device contact and said process member contact are exposed through an opening provided in said first frame.

6. A process cartridge detachably mountable to a main assembly of an image forming apparatus, said process cartridge comprising:

an electrophotographic photosensitive member;

a first frame supporting said electrophotographic photosensitive member;

a developing roller for developing, with a developer, an electrostatic latent image formed on said electrophotographic photosensitive member;

a developing blade for regulating a thickness of a layer of the developer carried on said developing roller;

a developer feeding member for supplying the developer to said developing roller;

a second frame supporting (i) said developing roller, (ii) said developing blade, and (iii) said developer feeding member, said second frame being movable relative to said first frame between a contact position where said developing roller contacts said electrophotographic photosensitive member and a spacing position where said developing roller is spaced from said electrophotographic photosensitive member;

a developing device contact which is provided at one end portion side of said second frame with respect to an axial direction of the developing roller and which is electrically connected with said developing roller, wherein said developing device contact is contacted to a first main assembly contact provided in the main assembly of the image forming apparatus when said process cartridge is mounted to the main assembly of the image forming apparatus;

a first process member contact which is provided at one end portion side of said second frame with respect to the axial direction of the developing roller and which is electrically connected with said developing blade, wherein said first process member contact is contacted to a second main assembly contact provided in the main assembly of the image forming apparatus when said process cartridge is mounted to the main assembly of the image forming apparatus; and a second process member contact which is provided at one end portion side of said second frame with respect to the axial direction of the developing roller and which is electrically connected with said developer feeding member, wherein said second process member contact is contacted to a third main assembly contact provided in the main assembly of the image forming apparatus when said process cartridge is mounted to the main assembly of the image forming apparatus, wherein, when said second frame is moved between the contact position and the spacing position, (i) a movement path along which said developing device contact moves overlaps a movement path along which said first process member contact moves, and (ii) a movement path along which said second process member contact moves overlaps a movement path along which said developing device contact moves, as said developing device contact, said first process member contact and said second process member contact are seen along the axial direction.

7. An apparatus according to claim 6, wherein said developing device contact and said first process member contact are provided by injection molding electroconductive resin material in said second frame.

8. An apparatus according to claim 6, wherein said developing device contact and said first process member contact are exposed through an opening provided in said first frame.

9. An apparatus according to claim 6, wherein said first process member contact, said developing device contact and said second process member contact are arranged in the order named with respect to a direction of movement of said second frame from the contact position to the spacing position.

10. A developing device detachably mountable to a main assembly of an image forming apparatus, said developing device comprising:

a developing roller for developing, with a developer, an electrostatic latent image formed on an electrophotographic photosensitive member;

a process member actable on said developing roller;

a frame supporting said developing roller and said process member, said frame being movable relative to the main assembly of the image forming apparatus between a contact position where said developing roller contacts the electrophotographic photosensitive member and a spacing position where said developing roller is spaced from the electrophotographic photosensitive member;

a developing device contact which is provided at one end portion side of said frame with respect to an axial direction of said developing roller and which is electrically connected with said developing roller, wherein said developing device contact is contacted to a first main assembly contact provided in the main assembly of the image forming apparatus when said developing device is mounted to the main assembly of the image forming apparatus; and a process member contact which is provided at one end portion side of said frame with respect to the axial direction of the developing roller and which is electrically connected with said process member, wherein said process member contact is contacted to a second main assembly contact provided in the main assembly of the image forming apparatus when said developing device is mounted to the main assembly of the image forming apparatus, wherein, when said frame is moved between the contact position and the spacing position, a movement path along which said developing device contact moves overlaps a movement path along which said process member contact moves, as said developing device contact and said process member contact are seen along the axial direction.

11. A device according to claim 10, wherein said developing device contact and said process member contact are provided by injection molding electroconductive resin material in said second frame.

12. A device according to claim 10, wherein said process member includes a developing blade for regulating a thickness of a layer of the developer carried on said developing roller.

13. A device according to claim 10, wherein said process member includes a developer feeding member for supplying the developer to said developing roller.

14. A developing device detachably mountable to a main assembly of an image forming apparatus, said developing device comprising:

a developing roller for developing, with a developer, an electrostatic latent image formed on an electrophotographic photosensitive member;

a developing blade for regulating a thickness of a layer of the developer carried on said developing roller;

a developer feeding member for supplying the developer to said developing roller;

a frame supporting said developing roller, said developing blade, and said developer feeding member, said frame being movable relative to the main assembly of the image forming apparatus between a contact position where said developing roller contacts the electrophotographic photosensitive member and a spacing position where said developing roller is spaced from the electrophotographic photosensitive member;

a developing device contact which is provided at one end portion side of said frame with respect to an axial direction of said developing roller and which is electrically connected with said developing roller, wherein said developing device contact is contacted to a first main assembly contact provided in the main assembly of the image forming apparatus when said developing device is mounted to the main assembly of the image forming apparatus;

a first process member contact which is provided at one end portion side of said frame with respect to the axial direction of said developing roller and which is electrically connected with said developing blade, wherein said first process member contact is contacted to a second main assembly contact provided in the main assembly of the image forming apparatus when said developing device is mounted to the main assembly of the image forming apparatus; and a second process member contact which is provided at one end portion side of said frame with respect to the axial direction of said developing roller and which is electrically connected with said developer feeding member, wherein said second process member contact is contacted to a third main assembly contact provided in the main assembly of the image forming apparatus when said developing device is mounted to the main assembly of the image forming apparatus, wherein, when said frame is moved between the contact position and the spacing position, (i) a movement path along which said developing device contact moves overlaps a movement path along which said first process member contact moves, and (ii) a movement path along which said second process member contact moves overlaps a movement path along which said developing device contact moves, as said developing device contact, said first process member contact, and said second process member contact are seen along the axial direction.

15. A device according to claim 14, wherein said developing device contact and said first process member contact are provided by injection molding electroconductive resin material in said frame.

16. A device according to claim 14, wherein said first process member contact, said developing device contact, and said second process member contact are arranged in the order named with respect to a direction of movement of said frame from the contact position to the spacing position.

17. An image forming apparatus for forming an image on a recording material, said image forming apparatus comprising:

(i) a main assembly;

(ii) a first main assembly contact provided in said main assembly;

(iii) a second main assembly contact provided in said main assembly;

(iv) a process cartridge dismountably mounted in said main assembly of the image forming apparatus, said process cartridge including:

an electrophotographic photosensitive member, a first frame supporting said electrophotographic photosensitive member, a developing roller for developing, with a developer, an electrostatic latent image formed on said electrophotographic photosensitive member, a process member actable on said developing roller, a second frame supporting said developing roller and said process member, said second frame being movable relative to said first frame between a contact position where said developing roller contacts said electrophotographic photosensitive member and a spacing position where said developing roller is spaced from said electrophotographic photosensitive member, a developing device contact which is provided at one end portion side of said second frame with respect to an axial direction of the developing roller and which is electrically connected with said developing roller, wherein said developing device contact is contacted to said first main assembly contact when said process cartridge is mounted to said main assembly of said image forming apparatus, and a process member contact which is provided at one end portion side of said second frame with respect to the axial direction of the developing roller and which is electrically connected with said process member, wherein said process member contact is contacted to said second main assembly contact when said process cartridge is mounted to said main assembly of said image forming apparatus, wherein, when said second frame is moved between the contact position and the spacing position, a movement path along which said developing device contact moves overlaps a movement path along which said process member contact moves, as said developing device contact and said process member contact are seen along the axial direction; and (v) feeding means for feeding the recording material.

18. An image forming apparatus for forming an image on a recording material, said image forming apparatus comprising:

(i) a main assembly;

(ii) a first main assembly contact provided in said main assembly;

(iii) a second main assembly contact provided in said main assembly;

(iv) a third main assembly contact provided in said main assembly;

(v) a process cartridge dismountably mounted in said main assembly of said image forming apparatus of the image forming apparatus, said process cartridge including:

an electrophotographic photosensitive member, a first frame supporting said electrophotographic photosensitive member, a developing roller for developing, with a developer, an electrostatic latent image formed on said electrophotographic photosensitive member, a developing blade for regulating a thickness of a layer of the developer carried on said developing roller, a developer feeding member for supplying the developer to said developing roller, a second frame supporting said developing roller, said developing blade and said developer feeding member, said second frame being movable relative to said first frame between a contact position where said developing roller contacts said electrophotographic photosensitive member and a spacing position where said developing roller is spaced from said electrophotographic photosensitive member, a developing device contact which is provided at one end portion side of said second frame with respect to an axial direction of the developing roller and which is electrically connected with said developing roller, wherein said developing device contact is contacted to said first main assembly contact when said process cartridge is mounted to said main assembly of said image forming apparatus, a first process member contact which is provided at one end portion side of said second frame with respect to the axial direction of the developing roller and which is electrically connected with said developing blade, wherein said first process member contact is contacted to said second main assembly contact when said process cartridge is mounted to said main assembly of said image forming apparatus, and a second process member contact which is provided at one end portion side of said second frame with respect to the axial direction of the developing roller and which is electrically connected with said developer feeding member, wherein said second process member contact is contacted to said third main assembly contact when said process cartridge is mounted to said main assembly of said image forming apparatus, wherein, when said second frame is moved between the contact position and the spacing position, (i) a movement path along which said developing device contact moves overlaps a movement path along which said first process member contact moves, and (ii) a movement path along which said second process member contact moves overlaps a movement path along which said developing device contact moves, as said developing device contact, said first process member contact, and said second process member contact are seen along the axial direction; and (vi) feeding means for feeding the recording material.

19. An image forming apparatus for forming an image on a recording material, said image forming apparatus comprising:

(i) a main assembly;

(ii) a first main assembly contact provided in said main assembly;

(iii) a second main assembly contact provided in said main assembly;

(iv) a developing device dismountably mounted to said main assembly of said image forming apparatus, said developing device including:

a developing roller for developing, with a developer, an electrostatic latent image formed on an electrophotographic photosensitive member, a process member actable on said developing roller, a frame supporting said developing roller and said process member, said frame being movable relative to said main assembly of said image forming apparatus between a contact position where said developing roller contacts the electrophotographic photosensitive member and a spacing position where said developing roller is spaced from the electrophotographic photosensitive member, a developing device contact which is provided at one end portion side of said frame with respect to an axial direction of said developing roller and which is electrically connected with said developing roller, wherein said developing device contact is contacted to said first main assembly contact provided in said main assembly of said image forming apparatus when said developing device is mounted to said main assembly of said image forming apparatus, and a process member contact which is provided at one end portion side of said frame with respect to the axial direction of said developing roller and which is electrically connected with said process member, wherein said process member contact is contacted to said second main assembly contact provided in said main assembly of said image forming apparatus when said developing device is mounted to said main assembly of said image forming apparatus, wherein, when said frame is moved between the contact position and the spacing position, a movement path along which said developing device contact moves overlaps a movement path along which said process member contact moves, as said developing device contact and said process member contact are seen along the axial direction; and (v) feeding means for feeding the recording material.

20. An image forming apparatus for forming an image on a recording material, said image forming apparatus comprising:

(i) a main assembly;

(ii) a first main assembly contact provided in said main assembly;

(iii) a second main assembly contact provided in said main assembly;

(iv) a third main assembly contact provided in said main assembly;

(v) a developing device dismountably mounted to said main assembly, said developing device including:

a developing roller for developing, with a developer, an electrostatic latent image formed on an electrophotographic photosensitive member, a developing blade for regulating a thickness of a layer of the developer carried on said developing roller, a developer feeding member for supplying the developer to said developing roller, a frame supporting said developing roller, said developing blade and said developer feeding member, said frame being movable relative to said main assembly of said image forming apparatus between a contact position where said developing roller contacts the electrophotographic photosensitive member and a spacing position where said developing roller is spaced from the electrophotographic photosensitive member, a developing device contact which is provided at one end portion side of said frame with respect to an axial direction of said developing roller and which is electrically connected with said developing roller, wherein said developing device contact is contacted to said first main assembly contact provided in said main assembly of said image forming apparatus when said developing device is mounted to said main assembly of said image forming apparatus, a first process member contact which is provided at one end portion side of said frame with respect to the axial direction of said developing roller and which is electrically connected with said developing blade, wherein said first process member contact is contacted to said second main assembly contact provided in said main assembly of said image forming apparatus when said developing device is mounted to said main assembly of said image forming apparatus, and a second process member contact which is provided at one end portion side of said frame with respect to the axial direction of said developing roller and which is electrically connected with said developer feeding member, wherein said second process member contact is contacted to said third main assembly contact provided in said main assembly of said image forming apparatus when said developing device is mounted to said main assembly of said image forming apparatus, wherein, when said frame is moved between the contact position and the spacing position, (i) a movement path along which said developing device contact moves overlaps a movement path along which said first process member contact moves, and (ii) a movement path along which said second process member contact moves overlaps a movement path along which said developing device contact moves, as said developing device contact, said first process member contact and said second process member contact are seen along the axial direction; and (vi) feeding means for feeding the recording material.

21. A process cartridge according to claim 1, wherein said second frame is rotatably connected with said first frame by a rotation shaft, and a distance between said rotation shaft and said developing device contact or said process member contact is shorter than a distance between said rotation shaft and a rotational axis of said electrophotographic photosensitive member, in a direction crossing with the axial direction.

22. A device according to claim 10, wherein said second frame is rotatably connected with said first frame by a rotation shaft, and a distance between said rotation shaft and said developing device contact or said process member contact is shorter than a distance between said rotation shaft and a rotational axis of said electrophotographic photosensitive member, in a direction crossing with the axial direction.

* * * * *